US007065309B2

(12) United States Patent
Sato

(10) Patent No.: US 7,065,309 B2
(45) Date of Patent: Jun. 20, 2006

(54) IMAGE FORMING APPARATUS WITH VARIABLE FIXING HEAT

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 23 days.

(21) Appl. No.: 10/923,850

(22) Filed: Aug. 24, 2004

(65) Prior Publication Data

US 2005/0047811 A1 Mar. 3, 2005

(30) Foreign Application Priority Data

Aug. 27, 2003 (JP) ..... 2003-208923

(51) Int. Cl.
*G03G 15/20* (2006.01)

(52) U.S. Cl. ..... 399/69; 399/67; 399/68

(58) Field of Classification Search ..... 399/68, 399/337, 324, 69, 322, 335, 330; 219/469, 219/216, 470, 471
See application file for complete search history.

(56) References Cited

U.S. PATENT DOCUMENTS 5,682,576 A * 10/1997 Sakai et al. ..... 399/69
5,966,562 A * 10/1999 Maehara ..... 399/69
6,108,500 A * 8/2000 Ohkama et al. ..... 399/67
2004/0047641 A1* 3/2004 Kato et al. ..... 399/69

FOREIGN PATENT DOCUMENTS

JP 07-325504 12/1995
JP 10-020703 1/1998

* cited by examiner

*Primary Examiner*—Arthur T. Grimley
*Assistant Examiner*—Laura K. Roth

(74) *Attorney, Agent, or Firm*—Rabin & Berdo, PC

(57) ABSTRACT

An image forming apparatus has a fixing unit that applies heat energy to non-fused developer on a medium. The medium is advanced in a transport path and a heater supplies heat energy to the fixing unit when the medium passes the fixing unit. When a trailing end of the medium is a predetermined distance upstream of the fixing unit, a controller operates in a first mode in which the controller causes the heater to supply a first amount of heat energy to the fixing unit. When the trailing end of the medium is within a predetermined distance upstream of the fixing unit, the controller operates in a second mode in which the controller causes the heater to supply a second amount of heat energy to the fixing unit. The second amount of heat energy is smaller than the first amount of heat energy.

6 Claims, 20 Drawing Sheets

IN A LOW-TEMPERATURE ENVIRONMENT

IN A LOW-TEMPERATURE ENVIRONMENT

IN A HIGH-TEMPERATURE ENVIRONMENT

IN A LOW-TEMPERATURE ENVIRONMENT

IMAGE FORMING APPARATUS WITH VARIABLE FIXING HEAT

BACKGROUND OF THE INVENTION

1. Field of the Invention

The present invention relates to an image forming apparatus.

2. Description of the Related Art

A conventional image forming apparatus such as a copying machine incorporates a heat-roller type fixing unit. The fixing unit includes a heat roller and a pressure roller. The heat roller incorporates a heat source such as a heater. The pressure roller is in pressure contact with the heat roller and is driven by the heat roller. A print medium passes through a nip formed between the heat roller and the pressure roller so that a toner image on the print medium is fused by heat under pressure. The heat source is controlled to generate a controlled amount of heat such that the surface temperature of the heat roller is optimum for fusing a toner image on a variety of types of print media.

FIG. 15 illustrates a configuration of an image forming section of a conventional image forming apparatus.

FIG. 16 illustrates a control block diagram of the conventional image forming apparatus.

Referring to FIG. 15, an image forming apparatus such as an electrophotographic printer and a copying machine incorporates an image forming section 20 and a fixing unit 24. The image forming section 20 includes a photoconductive drum 21, a charging unit 31, an LED (light emitting diode) head 33, a developing unit 32, and a transfer unit 22. The charging unit 31 charges the surface of the photoconductive drum 21 uniformly and the LED head 33 irradiates the charged surface of the photoconductive drum 21 with light in accordance with print data to form an electrostatic latent image on the photoconductive drum 21. The developing unit 32 applies toner to the electrostatic latent image to develop the electrostatic latent image into a toner image. The transfer unit 22 takes the form of, for example, a transfer roller and opposes the photoconductive drum 21 and transfers the toner image onto a print medium 23 that is being transported by a transporting unit, not shown. The fixing unit 24 includes fixing rollers that are in pressure contact with each other so that one of the fixing rollers drives the other in rotation.

A print controller 11 in FIG. 16 controls the operations of the image forming section 20 and fixing unit 24. The print controller 11 takes the form of a computer that includes primarily a microprocessor, an I/O port, and a timer, and a memory means such as a ROM and a RAM. The print controller 11 receives a print job from an external host apparatus such as a personal computer. The host apparatus generates a video signal that includes print data in bit map form and a control signal that commands printing of the print data, and sends the video signal and the control signals to the print controller 11. In accordance with the video signal and control signals, the print controller 11 controls the operations of the image forming section 20 and the fixing unit 24.

The print controller 11 is connected primarily to the charging unit 31, LED head 33, developing unit 32, the transfer unit 22, fixing unit 24, a remaining-medium sensor 30, and a temperature detector 15. The remaining-medium sensor 30 detects a remaining number of pages of the print medium 23. The temperature detector 15 detects the temperatures of, for example, the heat roller. Upon receiving a print command from the host apparatus, the print controller 11 checks the detection signal output from the temperature detector 15 to determine whether the temperature of the fixing unit 24 is within a predetermined range. If the temperature is out of the predetermined range, then the print controller 11 causes current to run through the heater 24*a* until the temperature is within the predetermined range.

Then, the print controller 11 supplies a voltage to the charging unit 31 which in turn charges the surface of the photoconductive drum 21. The print controller 11 then checks the detection signal outputted from the remaining-medium sensor 30 to determine whether the print medium 23 exists in the image forming apparatus. If the print medium 23 is available, the print controller 11 initiates to feed the print medium 23 to the image forming section 20.

When the print medium 23 reaches a predetermined position in a transport path, the print controller 11 sends timing signals including an advance direction sync signal and a traverse direction sync signal to the host apparatus. As previously described, the host apparatus generates a video signal that includes print data in bit map form, and sends the video signal to the print controller 11 on a line-by-line basis in synchronism with the timing signal.

The print controller 11 sends the received video signal to the LED head 33, the lines of the video signal being sent sequentially in synchronism with a clock signal. Once the print controller 11 has transmitted print data for one line to the LED head 33, the print controller 11 drives the LED head 33 to hold the print data for one line.

Then, print controller 11 drives the LED head 33 to energize LEDs in the LED head 33 in accordance with the print data for one line, so that the LEDs emit light to form an electrostatic latent image.

The LED head irradiates the surface of the photoconductive drum 21, negatively charged by the charging unit 31, with light. Charges in irradiated areas on the photoconductive drum 21 are dissipated so that the irradiated areas increase in potential to substantially zero volts to form dots on the photoconductive drum 21. The dots in turn form an electrostatic latent image as a whole. The developing unit 32 supplies negatively charged toner to the dots on the photoconductive drum 21 to form a toner image. As the photoconductive drum 21 rotates, the toner image is transported to the transfer unit 22 where the toner image is transferred onto the print medium 23 that passes a transfer point defined between the photoconductive drum 21 and the transfer unit 22.

The print medium 23 then passes through the fixing unit 24, so that the toner image on the print medium 23 is fused into a permanent image. The print medium 23 further advances to be discharged to a stacker outside of the image forming apparatus.

FIG. 17 illustrates a transport path of the print medium 23 in the conventional image forming apparatus.

As shown in FIG. 17, the image forming apparatus incorporates a paper cassette 34 in which a stack of print medium 23 is held therein. The paper cassette 34 has a paper guide 35 that aligns the print medium 23. When the print controller 11 initiates to feed the print medium 23 from the paper cassette 34, a top page of the stack of the print medium 23 is fed from the paper cassette 34 to the image forming section 20. When the medium-feed detector 25, disposed somewhere in the transport path of the print medium 23, detects the print medium 23, the print controller 11 drives the LED head 33 to initiate formation of an electrostatic latent image on the photoconductive drum 21. Subsequently, the print medium 23 is transported through the transfer unit 22 and then the fixing unit 24, and discharged to the outside of the image forming apparatus. A discharge sensors 26 and 27 are disposed downstream of the fixing unit 24 with respect to the direction of travel of the print medium 23 and detect the print medium 23.

FIGS. 18A–18B illustrate examples of configuration of the fixing unit 24 according to the conventional image forming apparatus.

FIG. 18A illustrates a configuration of the roller type fixing unit 24.

Fixing rollers each include an aluminum pipe 37 and a rubber layer 36 formed on the surface of the aluminum pipe 37. The fixing rollers are aligned vertically and rotated by a motor, not shown. The fixing rollers are heated by the heaters 24*a* so that the toner image on the print medium 23 is fused by heat under pressure.

FIG. 18B illustrates a configuration of the belt type fixing unit 24. The belt type fixing unit 24 uses a fixing belt 38. The nip 40 has a larger area when it is formed between the lower fixing roller and the fixing belt 38 than when it is formed between the upper and lower fixing rollers. Therefore, a larger amount of heat per unit time can be supplied to the print medium 23. The temperature detector 15 is disposed at a position X1 on the surface of the upper left roller. The nip 40 is at a position X2.

FIG. 19 is a graph of temperature versus time length during which the heater of the conventional roller type fixing heater is energized.

In order that the roller type fixing unit 24 has a large nip, the rubber layer 36 should be thick. For this reason, the roller type fixing unit 24 includes rollers usually having a large heat capacity. A large heat capacity requires a longer time for heat to be transferred. This delay time in heat transfer is a time length from when the heater 24*a* begins to be energized to supply heat energy to the fixing roller until the surface temperature of the fixing roller starts to increase. The delay time is usually several seconds for the conventional roller-type fixing unit 24.

A belt-type fixing unit 24 also requires the rubber layer 36 and therefore the belt type fixing unit 24 also includes rollers usually having a large heat capacity. For the belt type fixing unit 24, the distance X2–X1 between the temperature detector 15 and the nip 40 is long and thus it will be some time before the temperature at the nip 40 reaches the temperature detected by the temperature detector 15.

FIGS. 20A–20D illustrate the positions of print medium 23 within the image forming apparatus and show a delay time in detecting the temperature of the conventional belt type fixing unit 24.

FIG. 20A illustrates the position of the print medium 23 before a printing operation is initiated. FIG. 20B illustrates the position of print medium 23 when the leading end of the print medium 23 is a distance X2–X1 (FIG. 18B) upstream of the nip 40 in the fixing unit 24.

The temperature detector 15 detects the temperature in an area A on the belt 38 in FIG. 20B. The area A on the belt 38 will come into contact with the print medium 23 when the print medium 23 reaches the fixing point in FIG. 20C. Then, the heat in the area on the belt 38 is lost to the print medium 23 and the area A will reach a position in FIG. 20D where the temperature detector 15 detects the temperature of the area again. This fact implies that there is a delay in temperature detection of an area A on the belt 38 from when the area A comes into contact with the print medium 23 until the area A rotates back to the temperature detector 15. The fixing belt 38 of the belt type fixing unit 24 has a longer circumferential length than the fixing roller of a roller type fixing unit. Therefore, a delay in temperature detection is longer in the belt type fixing unit 24 than in the roller type fixing unit 24. The delay in temperature detection causes a delay in detecting that the print medium 23 has been discharged from the fixing unit 24, supplying an excess amount of heat to the fixing unit 24.

The temperature control of the fixing unit 24 will be described.

FIG. 21 illustrates a temperature control for the fixing unit 24 of the conventional image forming apparatus.

FIG. 21 shows an acceptable temperature range in which the fixing unit 24 can perform a fixing operation normally. If a printing operation is initiated when the temperature of the fixing unit 24 is lower than the lower limit of the acceptable temperature range, the toner image on the print medium 23 is not fused sufficiently into the print medium 23. This causes "cold offset" where the toner does not adhere to the print medium 23 but to the fixing roller. Conversely, if a printing operation is initiated when the temperature of the fixing unit 24 is higher than the upper limit of the acceptable temperature range, the toner image on the print medium 23 is heated excessively to lose its viscosity. This causes "hot offset" where the toner does not adhere to the print medium 23 but to the fixing roller.

The acceptable temperature range is determined by conditions such as the environmental temperature, the type and thickness of the print medium 23, and the speed of travel of the print medium 23. The print controller 11 has a memory area that holds a table of the temperature settings corresponding to the conditions.

Based on the detection signal generated by the temperature detector 15, the print controller 11 turns on the heater 24*a* when the surface temperature of the fixing roller is below a target temperature, and turn off the heater 24*a* when the surface temperature is higher than the target temperature. The temperature control is performed in this manner so that the surface temperature of the fixing roller is as close to the target temperature as possible during printing.

The fixing operation during printing will be described. When printing is initiated, the print controller 11 checks the detection signal received from the temperature detector 15 to determine whether the temperature of the fixing unit 24 is within the acceptable temperature range. Then, the print controller 11 performs one of the following operations depending on the temperature of the fixing unit 24:

(1) If the current temperature of the fixing unit 24 is within the acceptable temperature range, the print controller 11 sets the target temperature to a value that corresponds to the condition of the print medium 23 to be printed on subsequently.

(2) If the current temperature of the fixing unit 24 is lower than the acceptable temperature range for the subsequent page, the print controller 11 sets the target temperature to a value that corresponds to the condition of the subsequent pages of the print medium 23. Then, the print controller 11 energizes the heater 24*a* so that the temperature of the fixing unit 24 is within the acceptable temperature range. As soon as the temperature of the fixing unit 24 is within the acceptable temperature range, the respective motors are rotated to initiate a printing operation.

(3) If the current temperature of the fixing unit 24 is higher than the acceptable temperature range for the subsequent page, the print controller 11 sets the target temperature to a value that corresponds to the condition of the subsequent page of the print medium 23. Then, the print controller 11 causes the fixing unit 24 to dissipate heat without turning on the heater 24*a*. As soon as the temperature of the fixing unit 24 is within the acceptable temperature range, the respective motors are rotated to initiate a printing operation.

However, with the aforementioned conventional image forming apparatus, the temperature of the fixing unit 24 may overshoot to be out of the acceptable temperature range. When the temperature of the fixing unit 24 is out of the acceptable temperature range, if the print controller 11 receives a print command and performs a printing operation, hot offset will occur to impair print quality.

FIG. 22 illustrates an example of overshoot of the temperature of the fixing unit 24 of the conventional image forming apparatus.

Referring to FIG. 22, when continuous printing of a plurality of pages of print medium 23 is performed, the heater 24*a* is energized from the initiation of printing until the completion of printing. Once printing has completed, the fixing unit 24 does not lose heat to the print medium 23, and causing the temperature of the fixing unit 24 to overshoot so that the temperature of the fixing unit 24 becomes out of the acceptable temperature range. If a print command for the subsequent print job is received at time $t_a$, hot offset occurs due to an excessively high temperature of the fixing unit 24.

Of course, the fixing unit 24 will have lost an excessive amount of heat by time $t_b$ and printing can be performed normally if a print command for the subsequent print job is received at or after time $t_b$. This, however, implies that a certain waiting time should be allowed before the next printing job is initiated, causing a decrease in the throughput of the image forming apparatus.

SUMMARY OF THE INVENTION

An object of the invention is to provide an image forming apparatus in which the temperature of a fixing unit is controlled properly to eliminate overshoot of the temperature, hot offset, and a long waiting time before a subsequent printing job.

An image forming apparatus has a fixing unit that applies heat energy to non-fused developer on a medium. The apparatus includes a heater and a controller. The medium advances in a transport path and the heater supplies heat energy to the fixing unit when the medium passes through the fixing unit. When a trailing end of the medium is a predetermined distance more upstream of the fixing unit with respect to the transport path, the controller operates in a first mode in which the controller causes the heater to supply a first amount of heat energy to the fixing unit. When a trailing end of the medium is within a predetermined distance more upstream of the fixing unit, the controller operates in a second mode in which the controller causes the heater to supply a second amount of heat energy to the fixing unit. The second amount of heat energy is smaller than the first amount of heat energy.

The image forming apparatus further includes a medium length detector and a medium position detector. The medium length detector outputs a first detection signal indicative of a length of the medium. The medium position detector outputs a second detection signal indicative of passage of a leading end of the medium. The controller monitors the first detection signal and the second detection signal to detect a timing at which the trailing end of the medium passes through the fixing unit.

The image forming apparatus further includes a medium length memory and a medium position detector. The medium length memory holds a length of medium. The medium position detector detects passage of a leading end of the medium. The controller monitors the length of medium and the passage of the leading end of the medium to detect a timing at which a trailing end of the medium passes through the fixing unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Preferred embodiments of the invention will be described in detail with reference to the accompanying drawings.

FIRST EMBODIMENT

Figure 1:
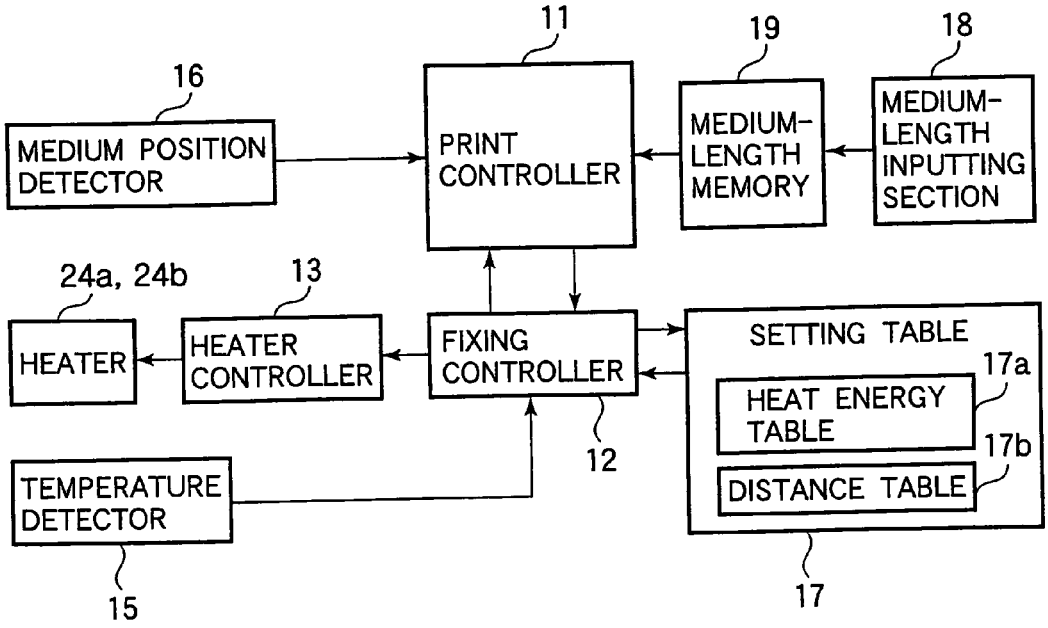
FIG. 1 illustrates the configuration of an image forming apparatus according to a first embodiment.

FIG. 1 illustrates the configuration of an image forming apparatus according to a first embodiment. Elements similar to those described in "DESCRIPTION OF THE RELATED ART" have been given the same reference numerals and the description thereof is omitted.

Referring to FIG. 1, a fixing controller 12 communicates with a print controller 11. The print controller 11 is connected to a medium position detector 16, a medium length memory 19, and a medium length inputting section 18. Reference is made to FIGS. 15–17 and FIGS. 18A and 18B and the associated descriptions for the configuration of the image forming apparatus according to the present invention.

The fixing controller 12 communicates with a heater controller 13, heaters 24*a* and 24*b*, and a temperature detector 15. The temperature detector 15 detects the temperatures of, for example, the heat rollers in the fixing unit 24. The heaters 24*a* and 24*b* take the form of, for example, a halogen lamp but may be of any type of heater provided that the fixing rollers can act as a heater properly. A motor, not shown, drives the fixing rollers in rotation under the control of the print controller 11.

A setting table 17 includes a heat energy table 17*a* and a distance table 17*b*. The heat energy table 17 lists heat energies that should be supplied to the print medium 23 in a low-energy mode which will be described later. The distance table 17*b* lists distances over which the print medium 23 travels while being supplied with the heat energy in the low-energy mode. The setting table 17 communicates with the fixing controller 12. Alternatively, the heat energy table 17*a* and the distance table 17*b* may be stored in the fixing controller 12.

The operation of the image forming apparatus of the aforementioned configuration will be described.

Figure 2:
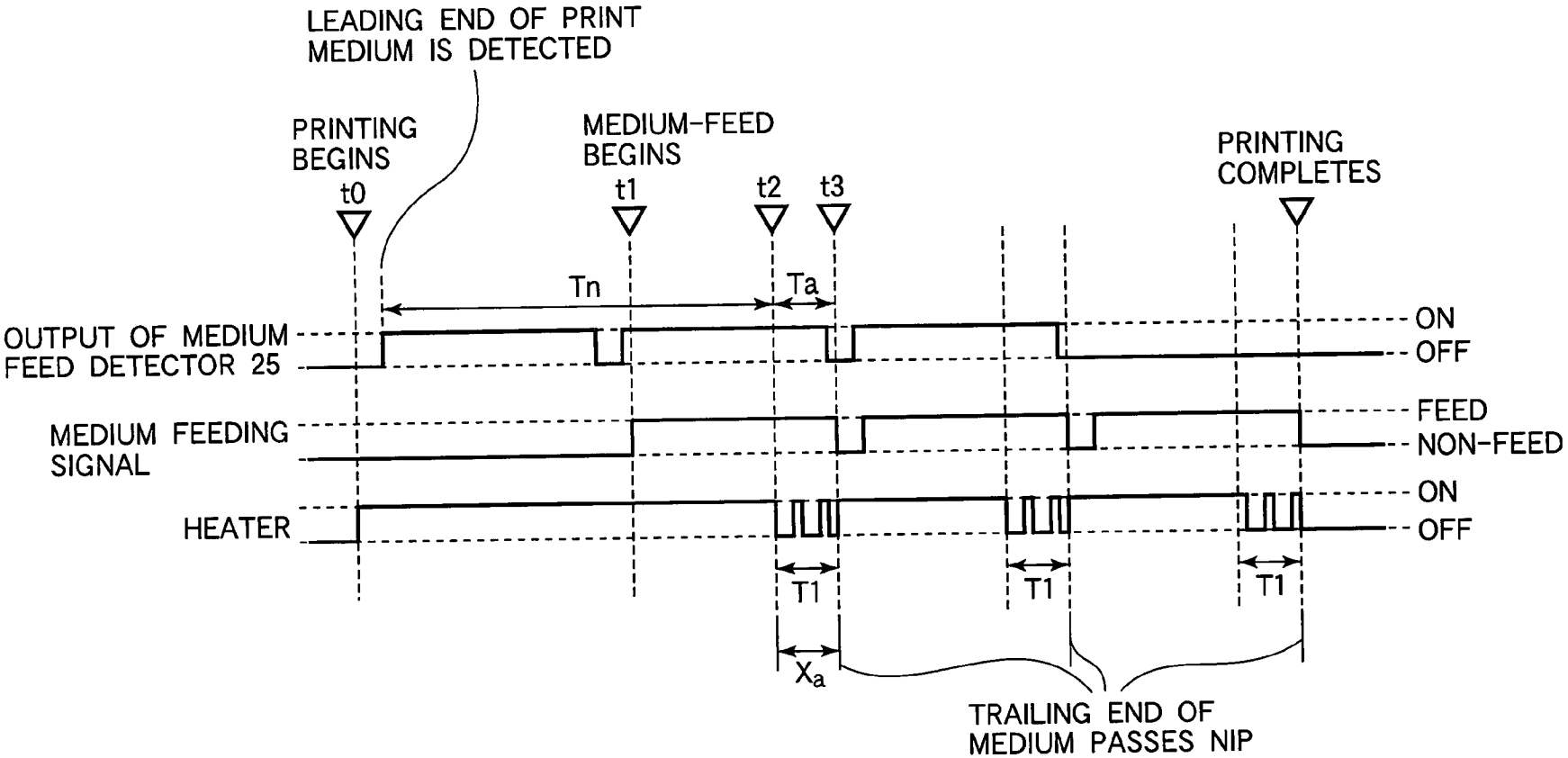
FIG. 2 is a timing chart illustrating the status of pertinent sections of the image forming apparatus during printing.

In a normal energy mode which will be described later, the heaters 24*a* and 24*b* are turned on or off when the temperature of the heat rollers is out of a predetermined range, not shown. This predetermined range is much narrower than an acceptable temperature range (FIG. 4) of the heat rollers. FIG. 2 is a timing chart illustrating the status of pertinent sections of the image forming apparatus during printing. FIG. 2 assumes that the temperature of the heat rollers of the fixing unit 24 is lower than the predetermined range and is decreasing before the fixing unit enters the low-energy mode and therefore the heaters 24*a* and 24*b* continue to be energized before the fixing unit enters the low-energy mode. In the low-energy mode, the heaters 24*a* and 24*b* are controlled to turn on and off at specific intervals.

FIGS. 3A–3D illustrate the positions of print medium 23 in the image forming apparatus during printing.

Figure 15:
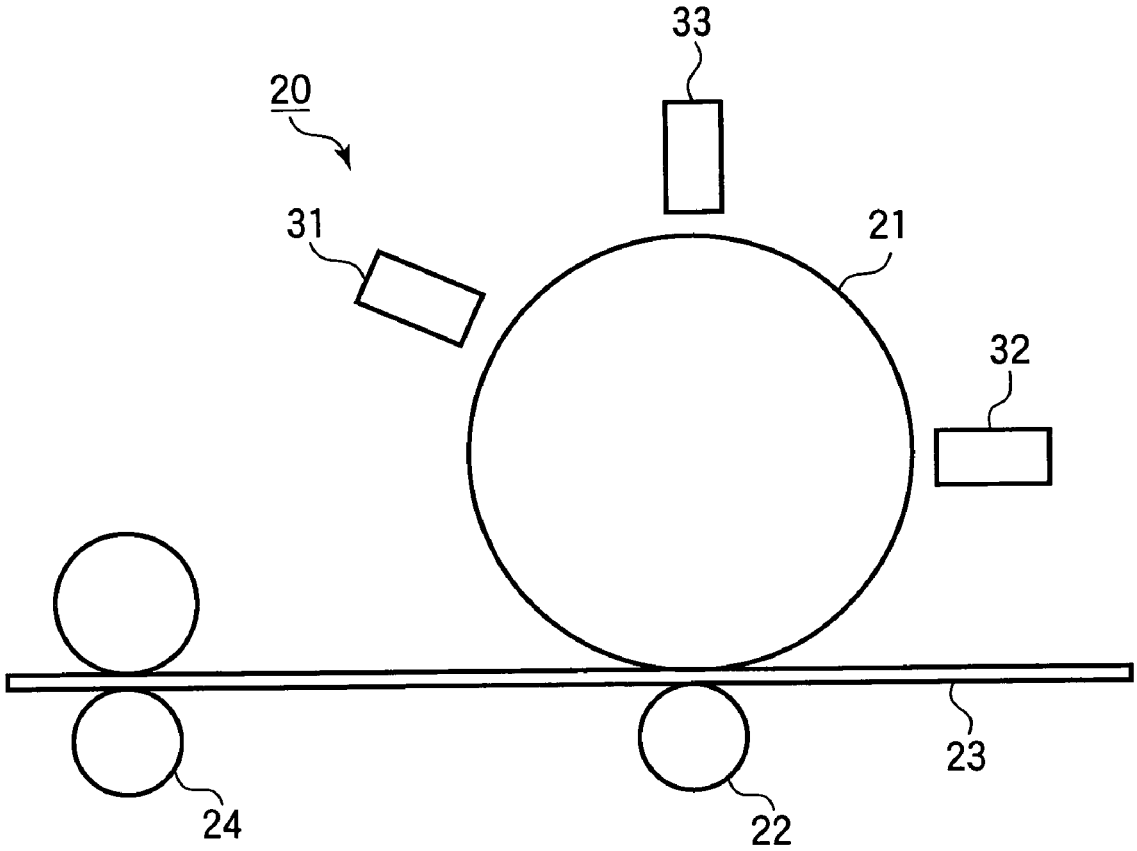
FIG.15 CONVENTIONAL ART
FIG. 15 illustrates a configuration of an image forming section of a conventional image forming apparatus.
Figure 16:
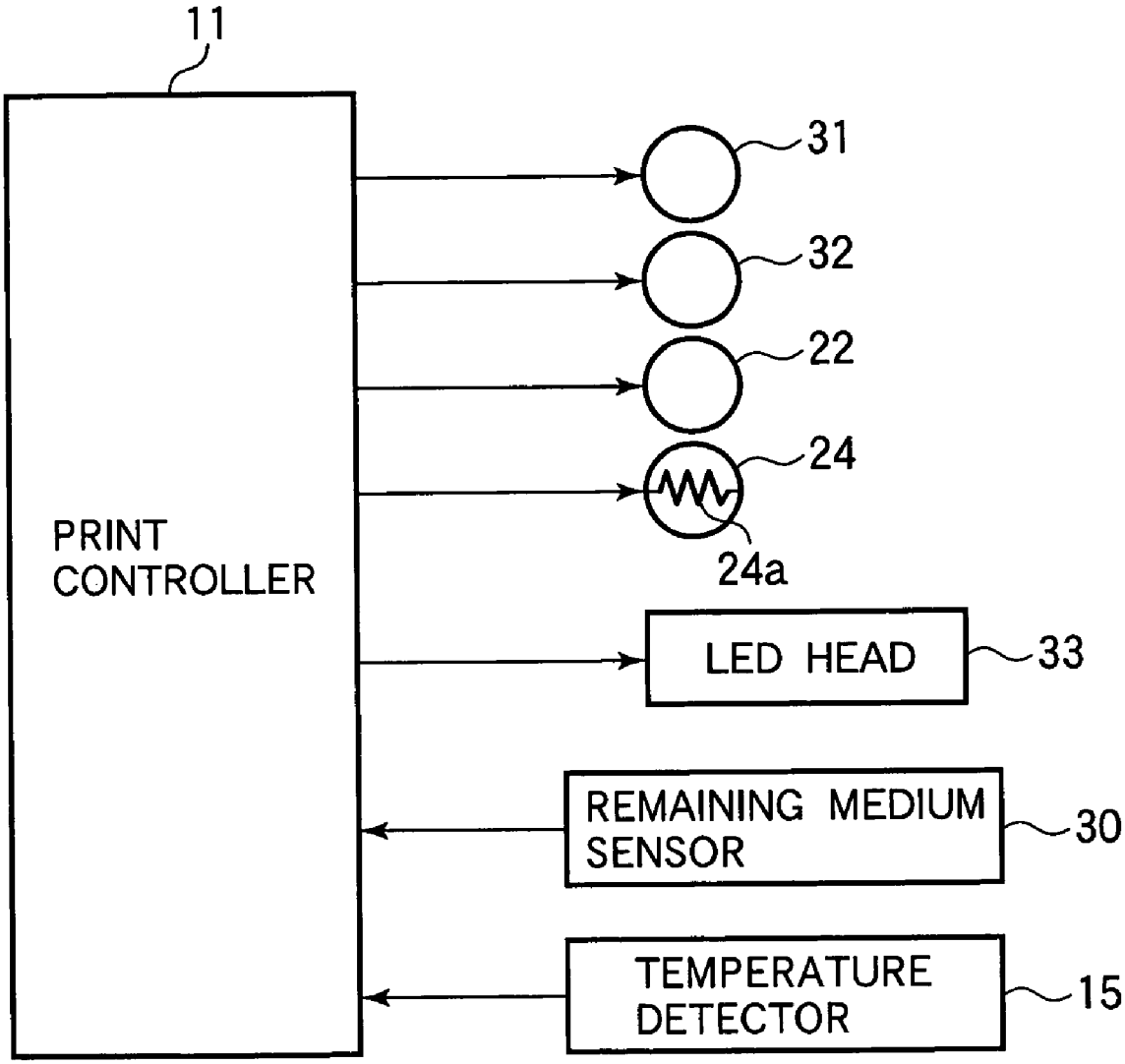
FIG.16 CONVENTIONAL ART
FIG. 16 illustrates a control block diagram of the conventional image forming apparatus.
Figure 17:
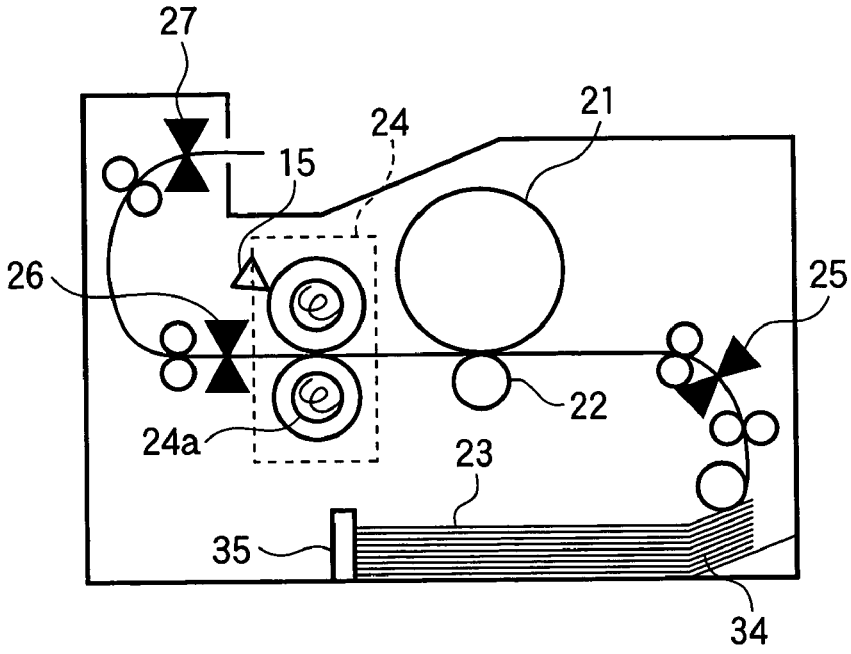
FIG.17 CONVENTIONAL ART
FIG. 17 illustrates a transport path of a print medium in the conventional image forming apparatus.
Figure 18A:
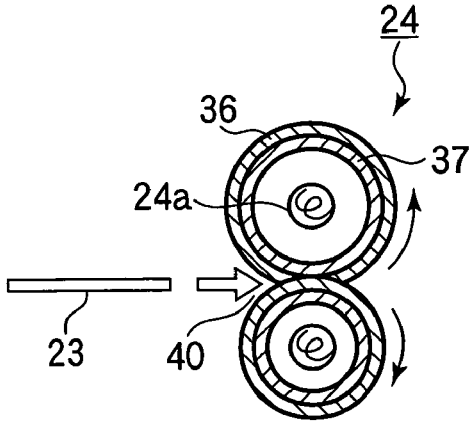
FIG.18A CONVENTIONAL ART
FIGS. 18A–18B illustrate a configuration of the fixing unit according to the conventional image forming apparatus, FIG. 18A illustrating a configuration of the roller type fixing unit and FIG. 18B illustrating a configuration of the belt type fixing unit.
Figure 18B:
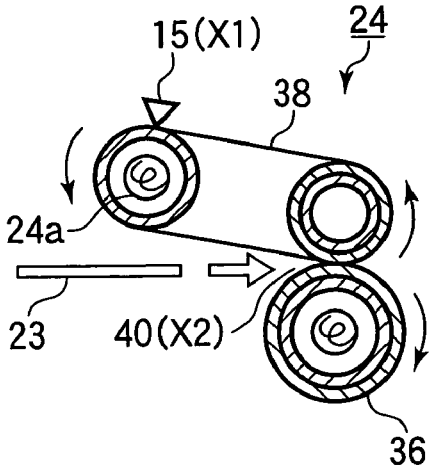
FIG.18B CONVENTIONAL ART
Figure 19:
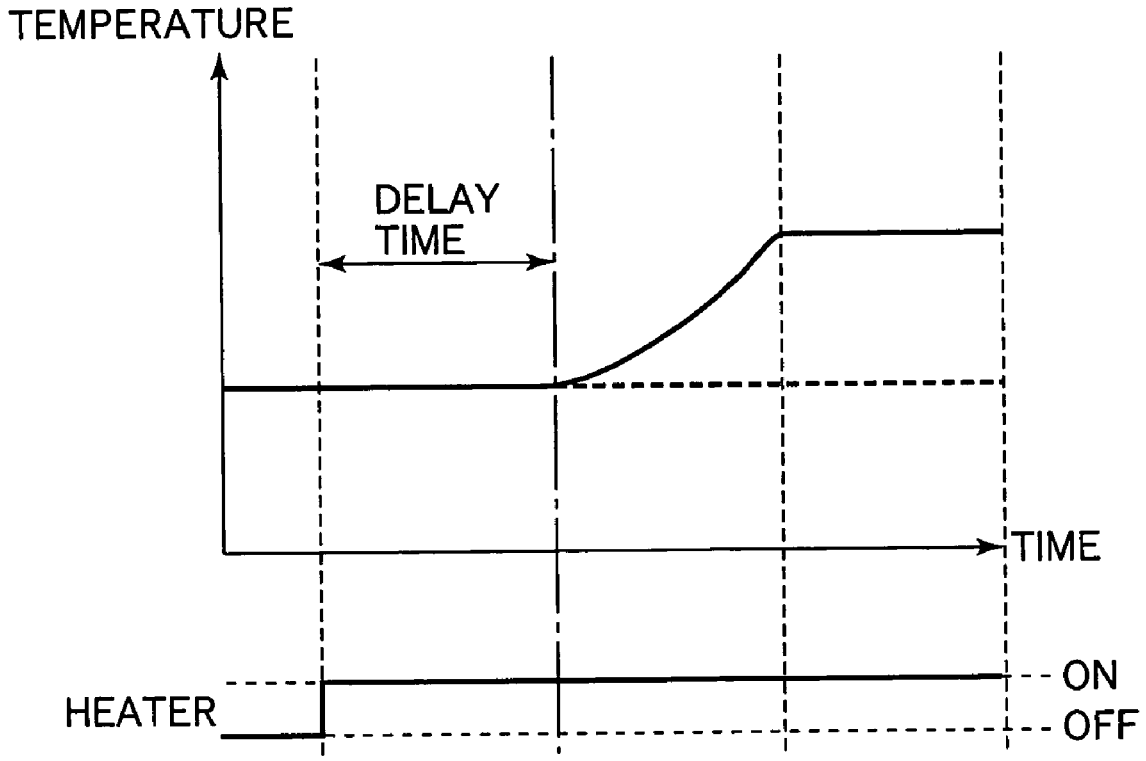
FIG.19 CONVENTIONAL ART
FIG. 19 is a graph of temperature versus time length during which a heater of the conventional roller type fixing heater is energized.
Figure 20A:
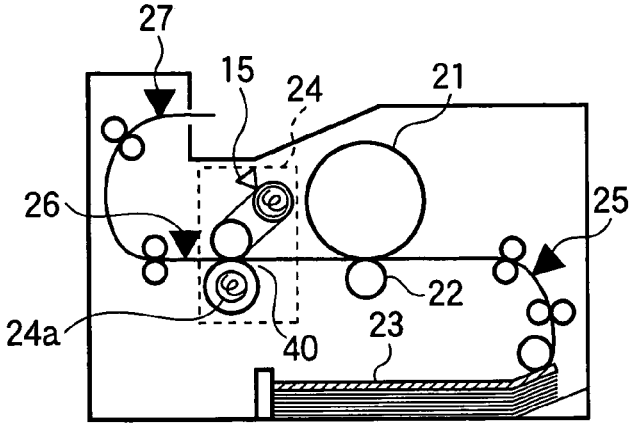
FIG.20A CONVENTIONAL ART
FIGS. 20A–20D illustrate the positions of a print medium within the image forming apparatus to show a delay time in detecting the temperature of the conventional belt type fixing unit.
Figure 20B:
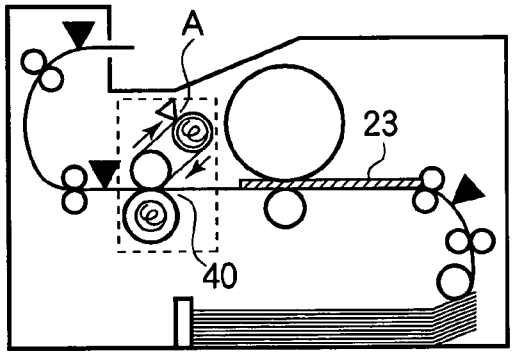
FIG.20B CONVENTIONAL ART
Figure 20C:
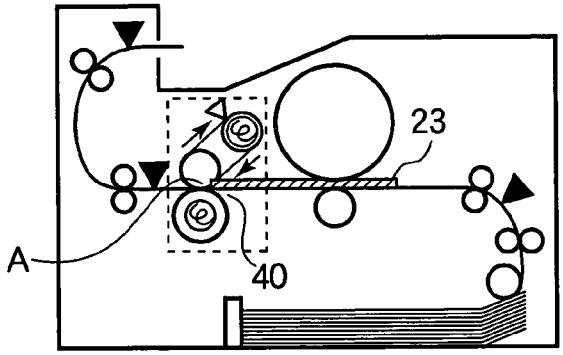
FIG.20C CONVENTIONAL ART
Figure 20D:
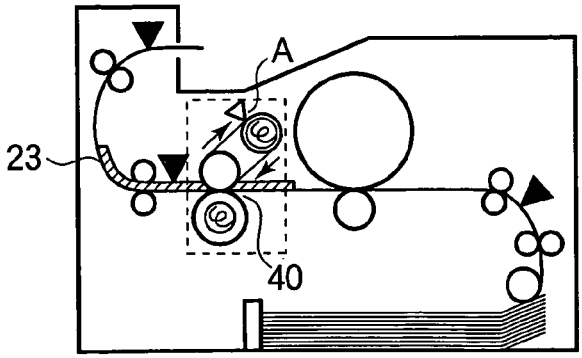
FIG.20D CONVENTIONAL ART
Figure 21:
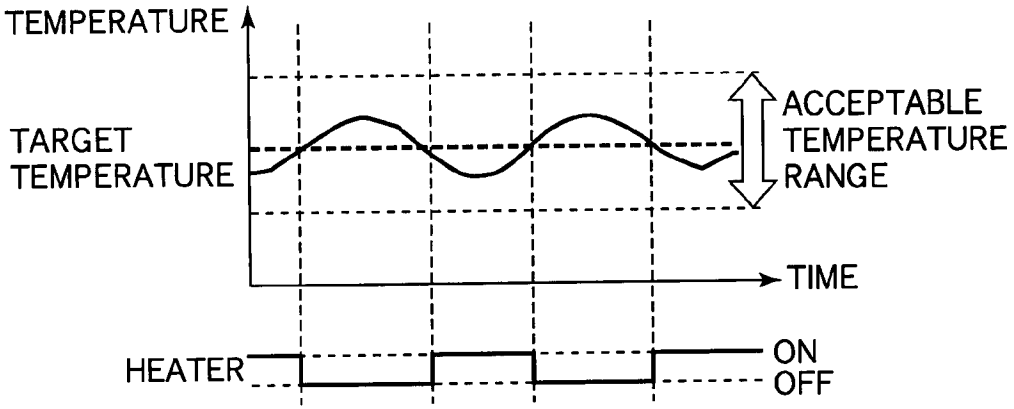
FIG.21 CONVENTIONAL ART
FIG. 21 illustrates a temperature control for the fixing unit of the conventional image forming apparatus.
Figure 22:
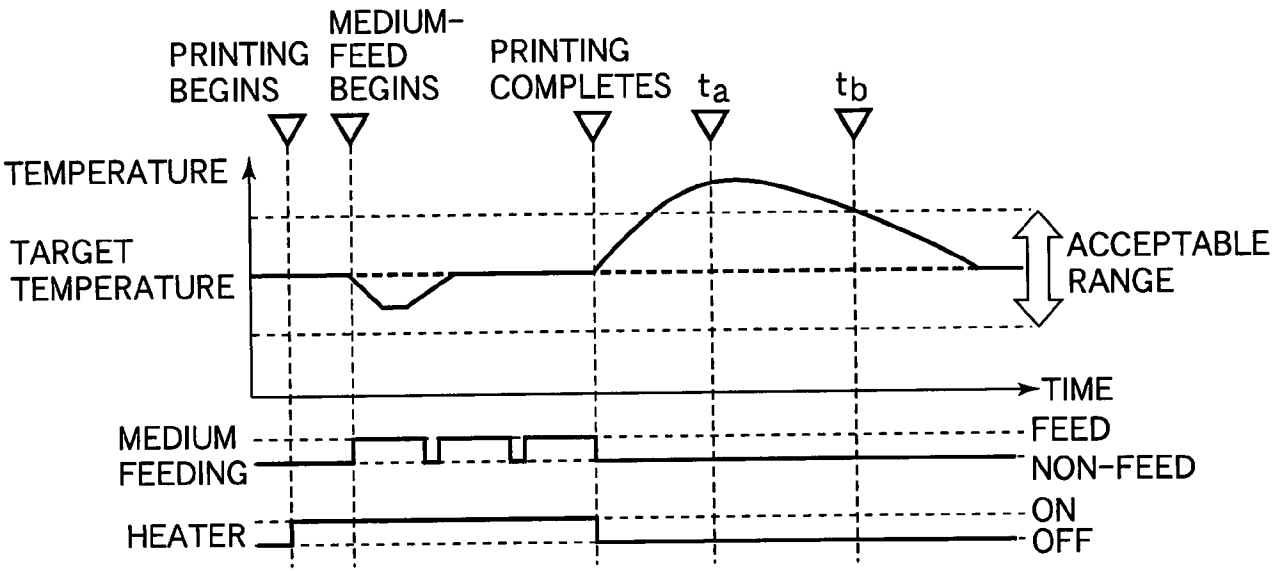
FIG.22 CONVENTIONAL ART
FIG. 22 illustrates an example of overshoot of the temperature of the fixing unit of the conventional image forming apparatus.

Referring to FIG. 2, a medium-feed detector 25 serves as the medium position sensor 16 in FIG. 1. When the medium-feed detector 25 detects the medium, an exposing unit 33 begins to form an electrostatic latent image on a photoconductive drum 21 (FIG. 15). A medium feeding signal indicates whether the print medium is passing through the fixing unit 24 and is determined based on the detection signals of the medium-feed detector 25 and a discharge sensor 26. A heater signal (HEATER) of the fixing unit 24 indicates whether the heaters 24*a* and 24*b* of the fixing unit 24 are energized. The heaters 24*a* and 24*b* cycle on and off during periods T1.

When a stack of the print medium 23 is loaded into the paper cassette 34, the user operates the medium length inputting section 18 to input a length-of-medium indicative of the length of the print medium 23 loaded in the paper cassette 34. Then, the medium length inputting section 18 in turn transmits the length-of-medium to the medium length memory 19.

Upon receiving a print command, the print controller 11 receives a length-of-medium from the medium length memory 19 and sends the length-of-medium to the fixing controller 12. Then, the fixing controller 12 accesses to the heat energy table 17*a* and the distance table 17*b* to read values for a heat energy in the low-energy mode and a distance over which the print medium 23 advances while receiving the heat energy in the low-energy mode from the fixing unit 24.

Figure 3A:
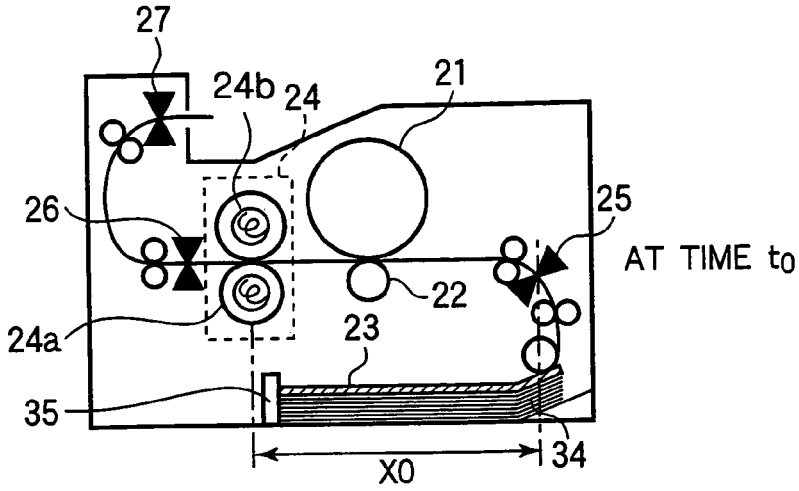
FIGS. 3A–3D illustrate the positions of a print medium in the image forming apparatus during printing.
Figure 3B:
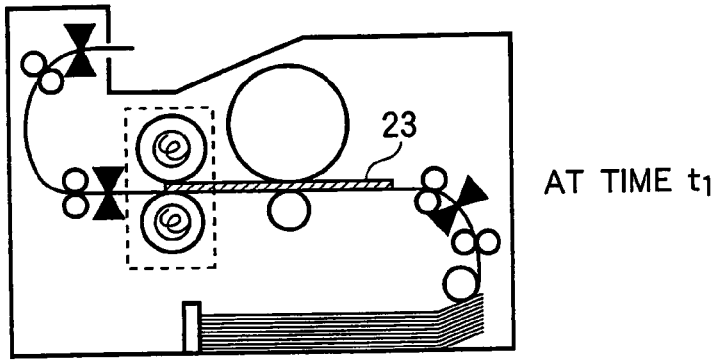

After having initiated a printing operation at time t0, the print controller 11 controls the heaters 24*a* and 24*b* to turn on so that the fixing unit 24 operates in the normal energy mode in which the heaters 24*a* and 24*b* in the fixing unit 24 are energized continuously. Then, the print controller 11 monitors the detection signals of the medium-feed detector 25 and the discharge sensor 26 to determine that time t1 is reached. As shown in FIG. 3B, the print medium 23 reaches the fixing unit 24 at time t1 and the fixing controller 12 controls the fixing unit 24 in the normal energy mode.

Figure 3C:
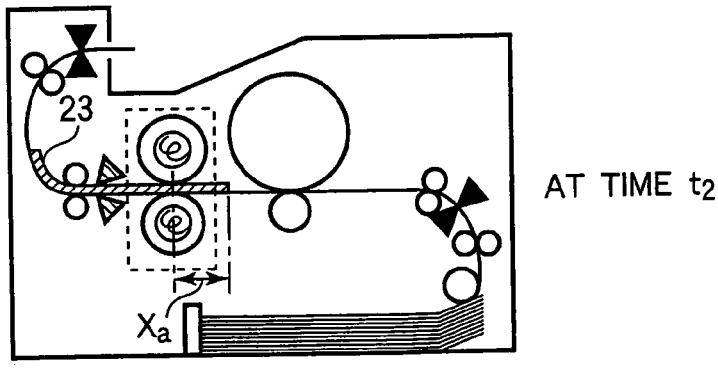

Then, at time t2, the print medium 23 reaches a position in FIG. 3C. Then, the fixing controller 12 controls the fixing unit to enter the low-energy mode in which the heaters 24*a* and 24*b* are energized intermittently at specific intervals for a time length of T1. At this moment, the trailing end of the print medium 23 is at a distance Xa from the nip 40, equal to the distance in the low-energy mode that has been read from the distance table 17*b*. In the present embodiment, the fixing controller 12 energizes the heaters 24*a* and 24*b* at specific intervals so that the heaters 24*a* and 24*b* generate an amount of heat equal to the heat energy in the low-energy mode that has been read from the heat energy table 17*a*. The fixing controller 12 maintains the supply of heat energy to the heaters 24*a* and 24*b* equal to the heat energy in the low-energy mode until the trailing end of the print medium 23 has passed the nip 40.

Figure 3D:
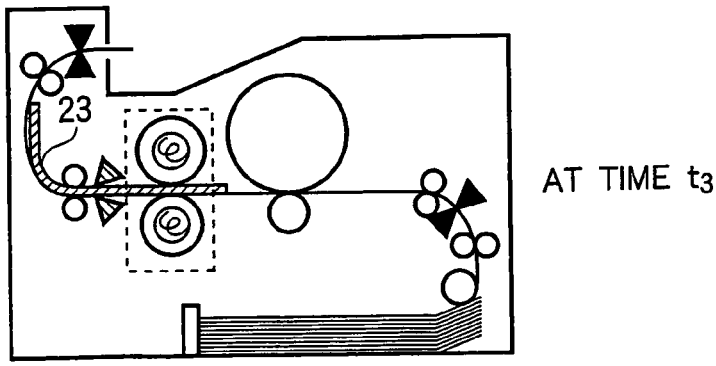

When the trailing end of the print medium 23 reaches a position in FIG. 3D at time t3, the fixing controller 12 controls the fixing unit 24 in the normal energy mode again. Thereafter, the aforementioned steps of control are performed repeatedly until all of the pages of a printing job have been printed.

A method of detecting the position of the print medium 23 in the transport path will be described with reference to FIG. 2 and FIGS. 3A–3D.

The time length (Tn and Ta in FIG. 2) during which the print medium 23 is advanced in the transport path can be determined at the time of manufacture of the image forming apparatus as follows:

When the medium-feed detector 25 detects the leading end of the print medium 23, i.e., when the output of the medium-feed detector 25 becomes ON, the print controller 11 calculates the time lengths Tn and Ta as follows:

$$Tn=\{Xo+(Lp-Xa)\}/Vp \text{ sec} \quad \text{Eq. (1)}$$

where Xa is a distance of the trailing end of the print medium 24 before the nip 40 at which the fixing unit enters the low-energy mode, Xa being experimentally determined previously for the length Lp of the print medium 23;

Tn is a time length from when the medium-feed detector 25 detects the leading end of the print medium 23 until the trailing end of the print medium 23 reaches a distance Xa before the nip 40;

Xo is the distance (FIG. 3A) from the medium-feed detector 25 to the nip 40;

Lp is the length of the print medium 23; and

Vp is the transport speed of the print medium 23.

$$Ta=Xa/Vp \text{ sec} \quad \text{Eq. (2)}$$

where Ta is the time length from when the trailing end of the print medium 23 reaches a distance Xa before the nip 40 until the trailing end of the print medium 23 passes the nip 40.

While the trailing end of the print medium 23 travels over the distance Xa, i.e., from the position in FIG. 3C to the position in FIG. 3D, the fixing controller 12 reduces an amount of heat energy supplied to the fixing unit 24 by turning on the heaters 24*a* and 24*b* at specific intervals.

Figure 4:
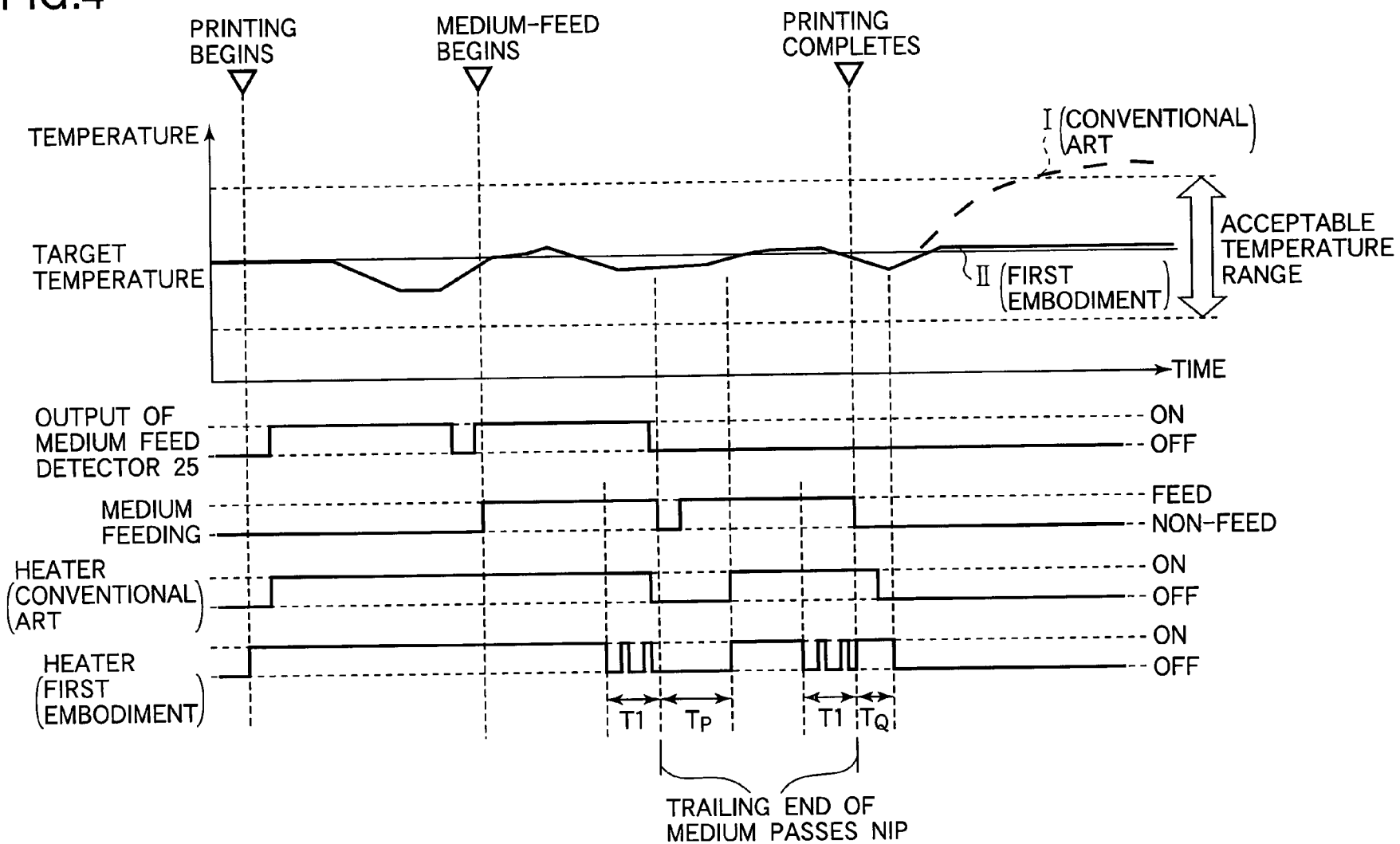
FIG. 4 illustrates temperature changes in a fixing unit.

FIG. 4 illustrates an example of temperature changes in the fixing unit 24.

It is to be noted that the heater controller 13 controls the heaters 24*a* and 24*b* to cycle on and off in accordance with the temperature of the heat rollers in the normal energy mode. When the temperature is lower than a predetermined range and is increasing, the heat controller 13 turns off ($T_P$) the heaters 24*a* and 24*b*. When the temperature is within or higher than the predetermined range and is increasing, the heat controller 13 turns off the heaters 24*a* and 24*b*. When the temperature is lower than the predetermined range and is decreasing, the heat controller 13 turns on ($T_Q$) the heaters 24*a* and 24*b*. In the low-energy mode, the heaters 24*a* and 24*b* are controlled to turn on and off at specific intervals.

As depicted in a solid line II in FIG. 4, the temperature of the fixing unit 24 is maintained within the acceptable temperature range during printing and after printing. In contrast, the temperature of a fixing unit of a conventional image forming apparatus increases after printing to overshoot as depicted in a solid line I.

Figure 5:
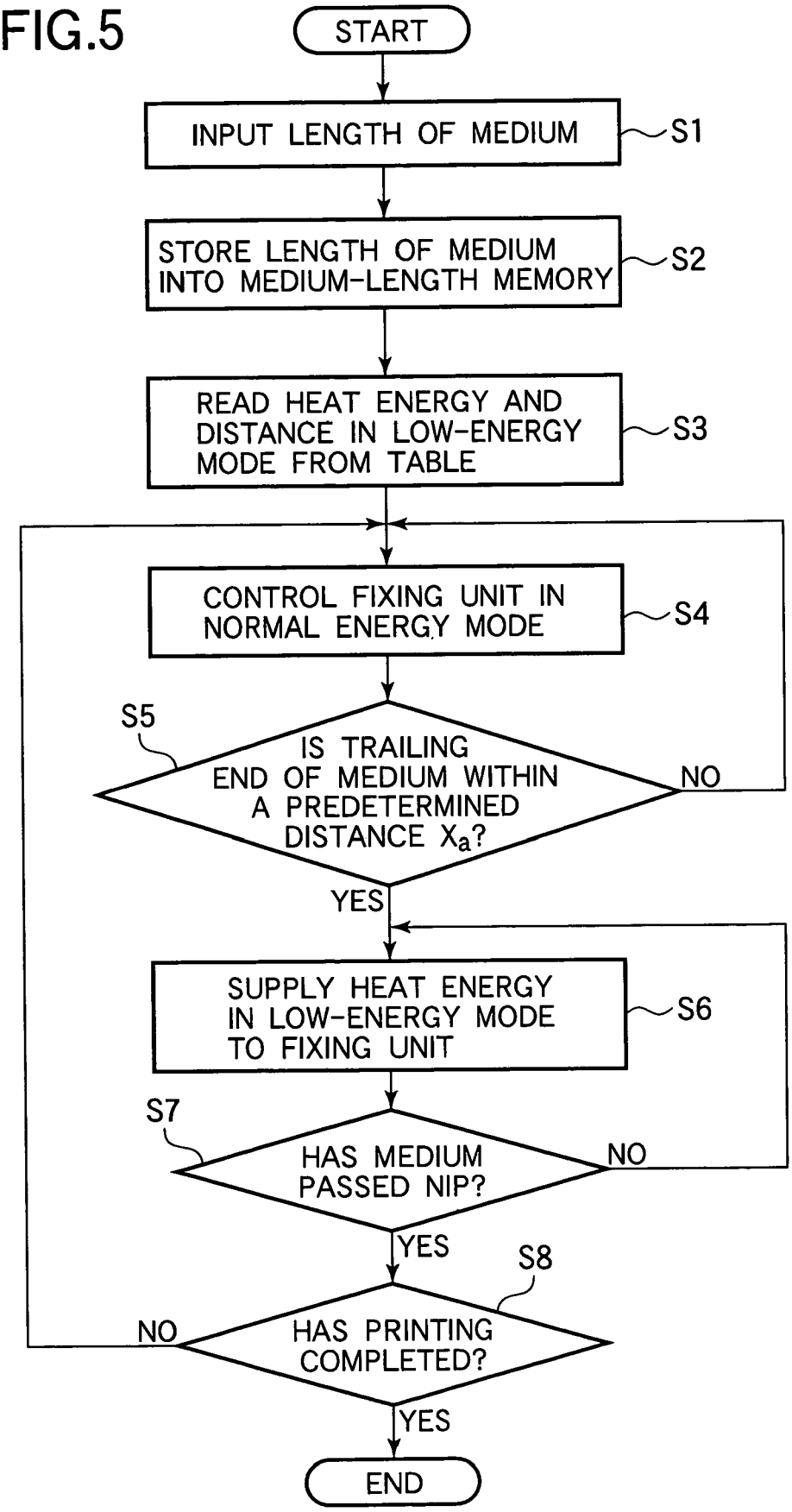
FIG. 5 is a flowchart illustrating the operation of the image forming apparatus.

FIG. 5 is a flowchart illustrating the operation of the image forming apparatus.

The flowchart will be described.

Step S1: The user inputs a length of medium through the medium length inputting section 18.

Step S2: The length of medium is stored into the medium length memory 19.

Step S3: The heat energy in the low-energy mode and the distance Xa in the low-energy mode are read from the setting table 17.

Step S4: The print controller 12 controls the fixing unit 24 in the normal energy mode.

Step S5: A check is made to determine whether the trailing end of the print medium 23 is within the distance Xa from the nip 40. If the answer is YES, then the program proceeds to step S6. If the answer is NO, the program jumps back to step S4.

Step S6: The print controller 12 supplies the heat energy in the low-energy mode to the fixing unit 24.

Step S7: A check is made to determine whether the print medium 23 has passed the nip 40. If the answer is YES, then the program proceeds to step S8. If the answer is NO, the program jumps back to step S6.

Step S8: A check is made to determine whether printing has been completed. If the answer is YES, then the program ends. If NO, the program jumps back to step S4.

Because the fixing controller 12 controls the fixing unit 24 to generate a smaller amount of heat energy in the low-energy mode than in the normal energy mode, an unwanted temperature increase due to an excess amount of heat stored in the fixing unit 24 can be prevented. Thus, the aforementioned control eliminates the need for delaying the initiation of the subsequent printing operation, thereby preventing the throughput of the image forming apparatus from decreasing.

While the first embodiment has been described with respect to a case in which the user inputs a length of medium through the medium length inputting section 18, the print data may include data that describes a length of print medium. In such a case, the length of medium is stored into the medium length memory 19 and the print controller 11 retrieves the length of print medium 23 from the medium length memory 19.

The value of the heat energy in the low-energy mode that corresponds to the length of print medium 23 and the value of the distance Xa in the low-energy mode may be calculated by means of predetermined equations. The heat energy in the low-energy mode is less than the heat energy that is supplied to the fixing unit 24 in the normal energy mode.

SECOND EMBODIMENT

Elements similar to those in the first embodiment have been given the same reference numerals and the description thereof is omitted.

Figure 6:
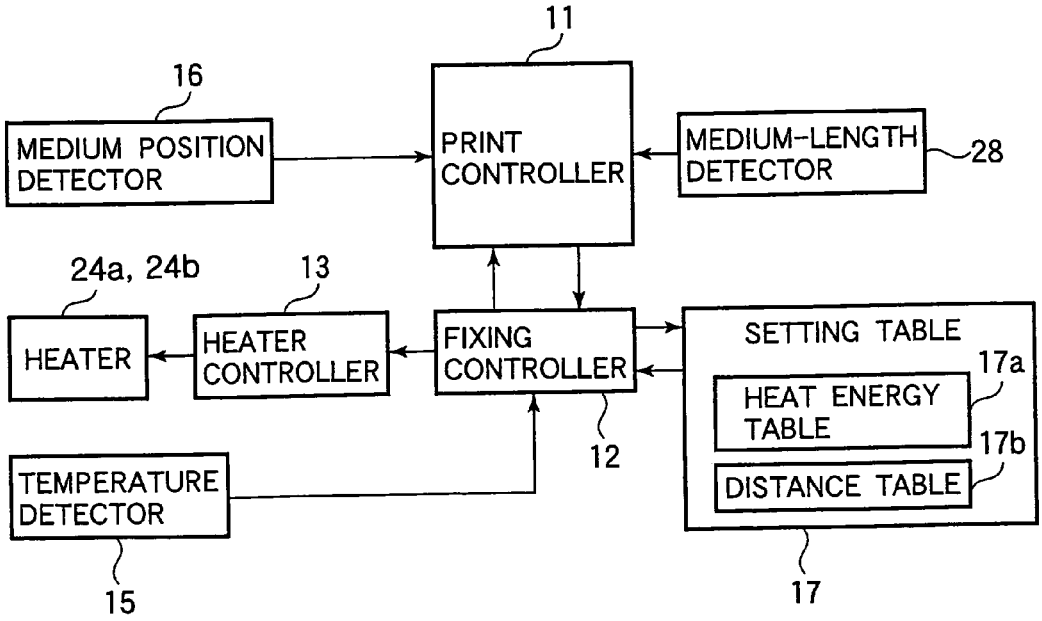
FIG. 6 illustrates the configuration of a controller for an image-forming apparatus according to a second embodiment.

FIG. 6 illustrates the configuration of a controller for an image-forming apparatus according to a second embodiment.

The second embodiment differs from the first embodiment in that a medium length detector 28 is used in place of the medium length inputting section 18 and the medium length memory 19.

The operation of the image-forming apparatus of the aforementioned configuration will be described.

Figure 7:
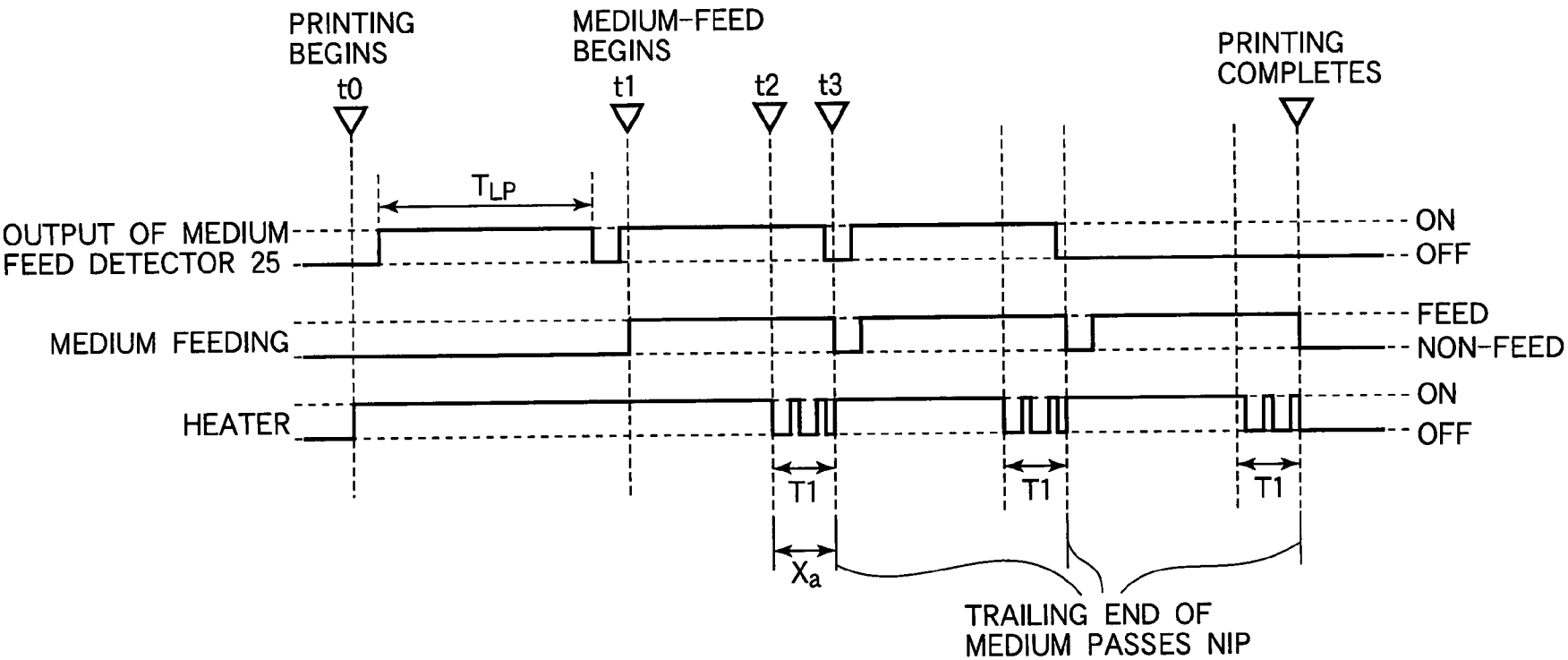
FIG. 7 is a timing chart illustrating the status of pertinent sections during printing according to the second embodiment.

FIG. 7 is a timing chart illustrating the status of pertinent sections during printing according to the second embodiment. The heaters 24*a* and 24*b* are turned on or off when the temperature of the heat rollers is out of a predetermined range. This predetermined range is much narrower than an acceptable temperature range (FIG. 4) of the heat rollers. FIG. 7 assumes that the temperature of the heat rollers of the fixing unit 24 is lower than the predetermined range and is decreasing before the fixing unit enters the low-energy mode. Therefore, the heaters 24*a* and 24*b* continue to be energized before the fixing unit enters the low-energy mode.

Figure 8:
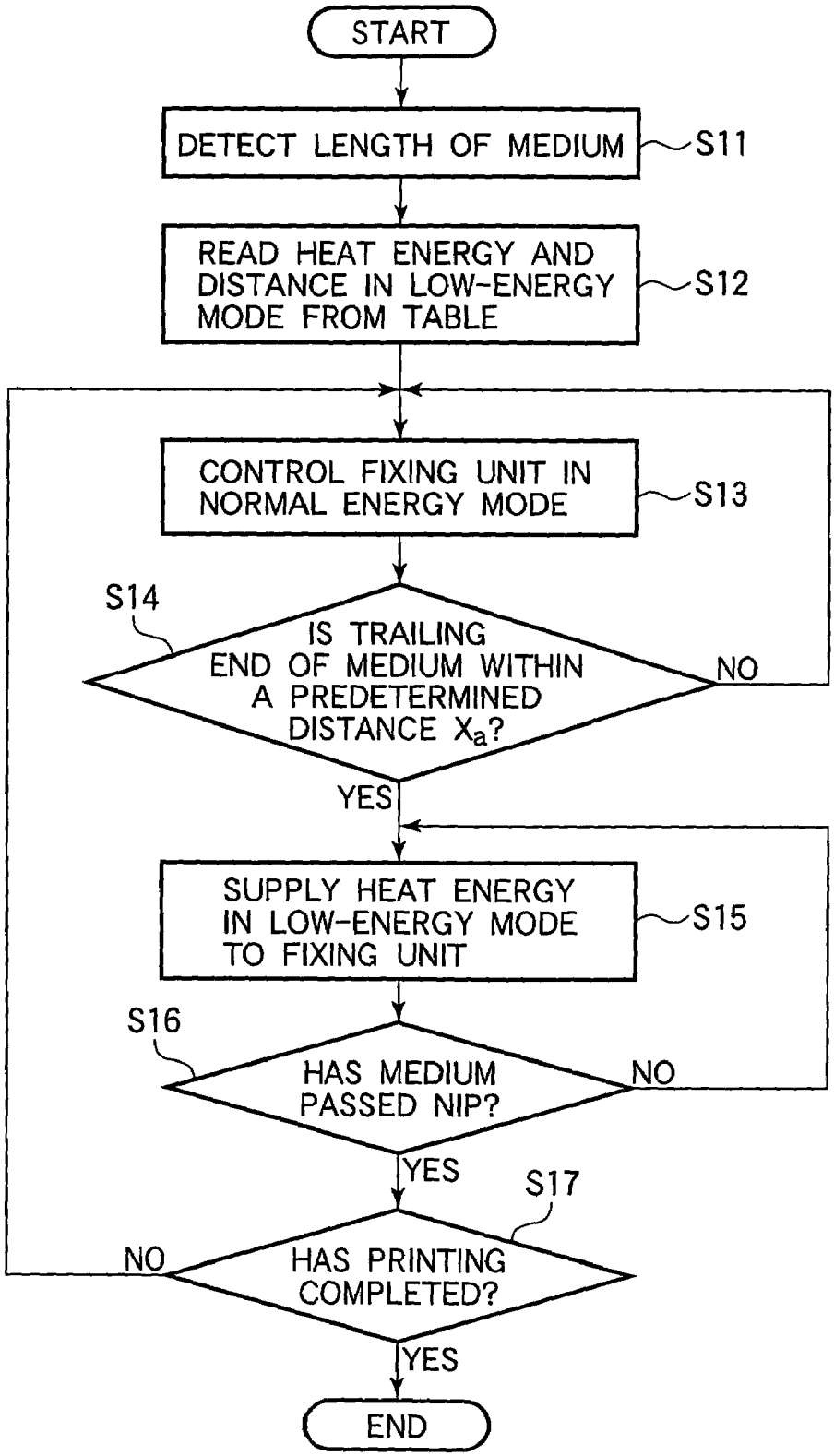
FIG. 8 is a flowchart illustrating the operation of the image forming apparatus according to the second embodiment.

FIG. 8 is a flowchart illustrating the operation of the image forming apparatus.

Referring to FIG. 7, a medium-feed detector 25 serves as a medium position sensor 16 in FIG. 6. A medium feeding signal is a signal determined based on the detection signals of the medium-feed detector 25 and a discharge sensor 26, and indicates whether the print medium 23 is being advancing in a transport path. A drive signal of the fixing unit 24 indicates whether the heaters 24*a* and 24*b* of the fixing unit 24 are energized.

The second embodiment differs from the first embodiment in a processing for the fixing controller 12 to obtain the length of print medium and in a method for calculating the distance in the low-energy. Upon receiving a print command, the print controller 11 receives a length-of-medium from a medium length detector 28 and sends the length-of-medium to the fixing controller 12. The medium length detector 28 is in the form of a switch operatively associated with a paper guide 35 (e.g., FIG. 3A) of the paper cassette 34 and detects the length of the print medium 23 in terms of the position of the paper guide 35.

Upon receiving a print command, the print controller 12 receives a length-of-medium from the medium length detector 28. Then, the print controller 12 accesses to a heat energy table 17*a* to retrieve a value of the heat energy in the low-energy mode corresponding to the length of print medium 23, and a distance table 17*b* to retrieve a value of the distance in the low-energy mode.

After initiating a printing operation at time t0, the print controller 11 monitors the detection signals of the medium-feed detector 25 and the discharge sensor 26 to determine that time t1 is reached. The print medium 23 reaches the fixing unit 24 at time t1 and the fixing controller 12 controls the fixing unit 24 in the normal energy mode.

When the trailing end of the print medium 23 reaches a distance Xa from the nip of the fixing unit 24 at time t2, the fixing controller 12 switches the mode of operation of the fixing unit 24 from the normal-energy mode to the low-energy mode. In the low-energy mode, the heaters 24*a* and 24*b* are energized at specific intervals intermittently as shown in FIG. 7, thereby reducing the amount of heat supplied to the fixing unit 24. The fixing controller 12 controls the fixing unit 24 in the low-energy mode until the trailing end of the print medium 23 has passed the nip 40.

When the trailing end of the print medium 23 has passed the nip 40 of the fixing unit 24 at time t3, the fixing controller 12 controls the fixing unit 24 in the normal energy mode. Thereafter, the aforementioned steps of control are performed repeatedly until all of the pages of a printing job have been printed.

Another method of detecting the length of print medium will be described.

When the medium-feed detector 25 detects the leading end of the print medium i.e., when the output of the medium-feed detector 25 becomes ON, the print controller 11 calculates the length of print medium 23 as follows:

First, the time period tLp from when the medium-feed detector 25 detects the leading end of the print medium 23 until the medium-feed detector 25 detects the trailing end of the print medium 23 is determined. Then, the length of print medium 23, Lp, is calculated as follows:

$$Lp = tLp \times Vp \text{ mm} \qquad \text{Eq. (3)}$$

where Lp is the length of print medium 23 and Vp is the transport speed of the print medium 23.

As described above, the length of the print medium 23, Lp can be detected. Then, just as in the first embodiment, the position of the print medium 23 is calculated based on the length of the print medium 23, thereby performing the aforementioned control.

The flowchart will be described.

Step S11: The length of the print medium 23 is calculated based on the detection signals of the medium-feed detector 25.

Step S12: The heat energy in the low-energy mode and the distance Xa in the low-energy mode are read from the setting table 17.

Step S13: The print controller 12 controls the fixing unit 24 in the normal energy mode.

Step S14: A check is made to determine whether the trailing end of the print medium 23 is within the distance Xa from the nip 40. If the answer is YES, then the program proceeds to step S15. If the answer is NO, the program jumps back to step S13.

Step S15: The print controller 12 supplies the heat energy in the low-energy mode read from the setting table 17 to the fixing unit 24.

Step S16: A check is made to determine whether the print medium 23 has passed the nip 40. If the answer is YES, then the program proceeds to step S17. If the answer is NO, the program jumps back to step S15.

Step S17: A check is made to determine whether printing has been completed. If the answer is YES, then the program ends. If NO, the program jumps back to step S13.

The second embodiment allows calculation of a correct length of print medium even when a length-of-medium inputted through the medium length inputting section 18 differs from the actual length of the print medium 23. Therefore, the second embodiment can prevent overshoot of the temperature of the fixing unit 24.

THIRD EMBODIMENT

Elements similar to those in the first and second embodiments have been given the same reference numerals and the description thereof is omitted. Changes in printing conditions such as environment and printing speed causes changes in the amount of heat required to be supplied to the print medium 23. The amount of heat that should be supplied from a fixing unit 24 changes accordingly. In a third embodiment, the amount of heat to be supplied to the fixing unit 24 is corrected in accordance with printing conditions, thereby preventing the temperature of the fixing unit 24 from overshooting to eliminate cold offset.

Figure 9:
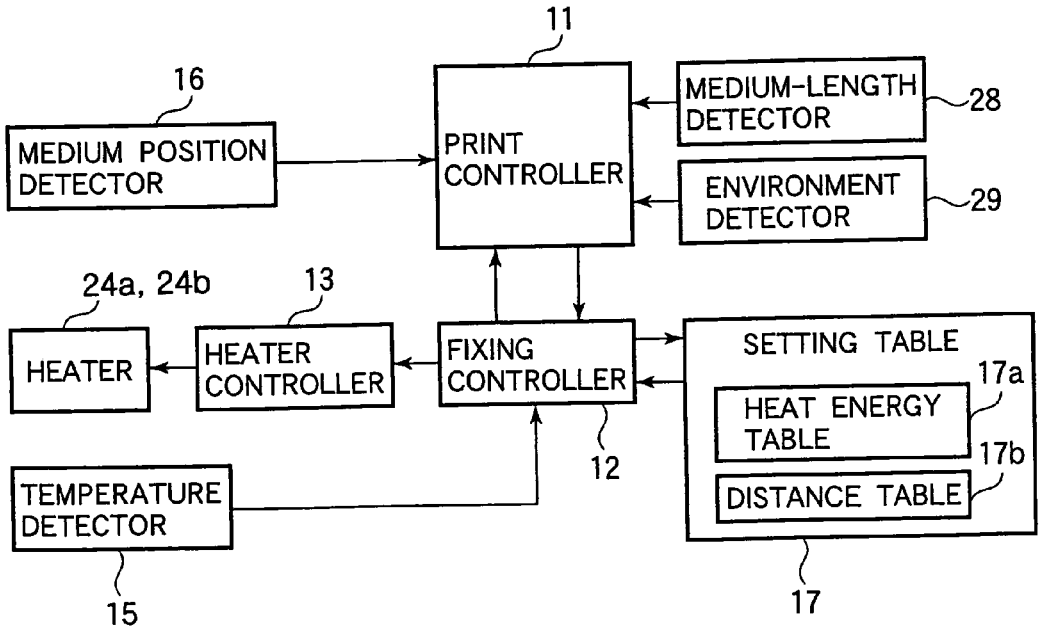
FIG. 9 illustrates the configuration of an image-forming apparatus according to a third embodiment.

FIG. 9 illustrates the configuration of an image-forming apparatus according to the third embodiment.

Referring to FIG. 9, the configuration of the third embodiment is much the same as the second embodiment except that an environment detector 29 is coupled to a print controller 11.

The operation of the image-forming apparatus of the aforementioned configuration will be described.

Figure 10:
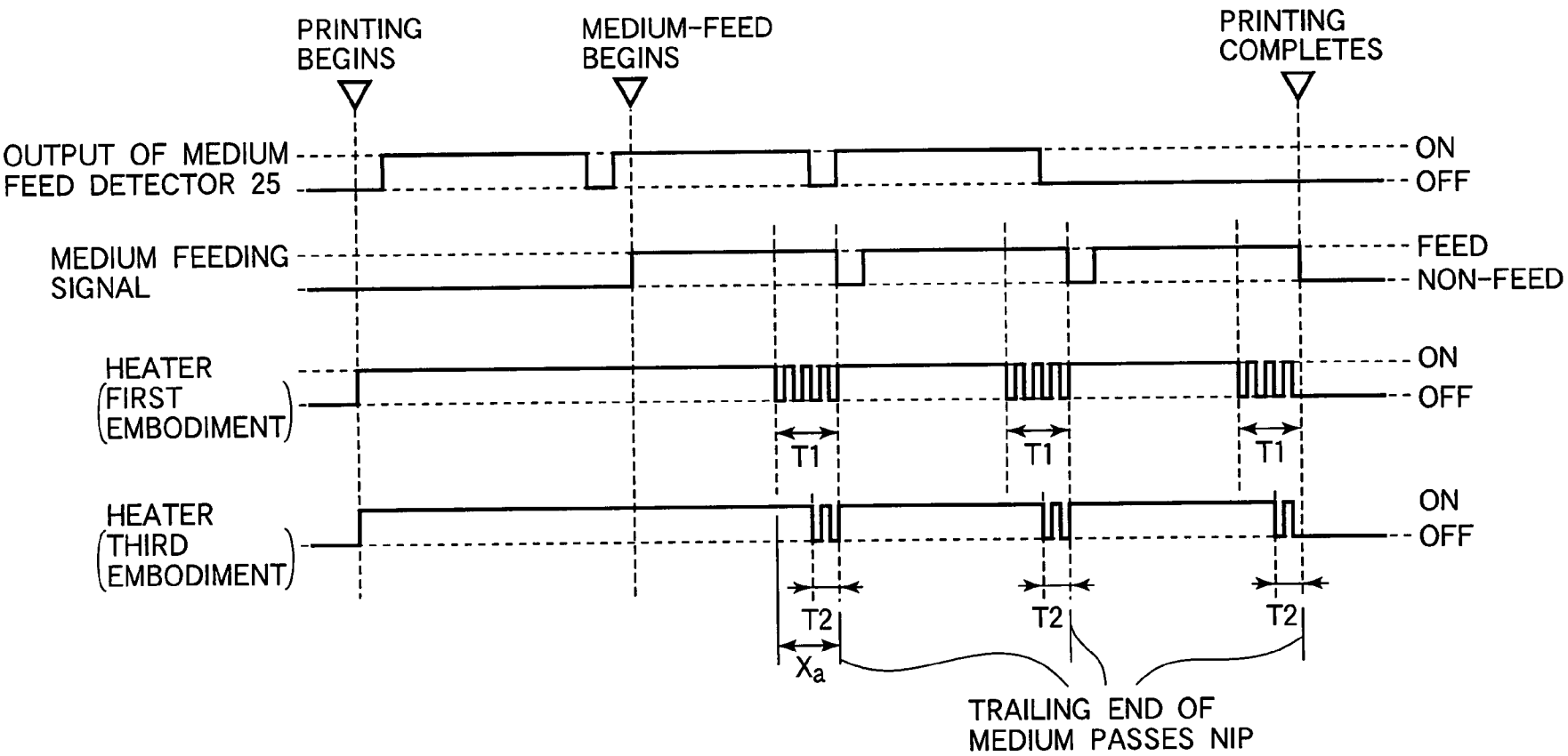
FIG. 10 is a first timing chart illustrating the operation of the third embodiment.
Figure 11:
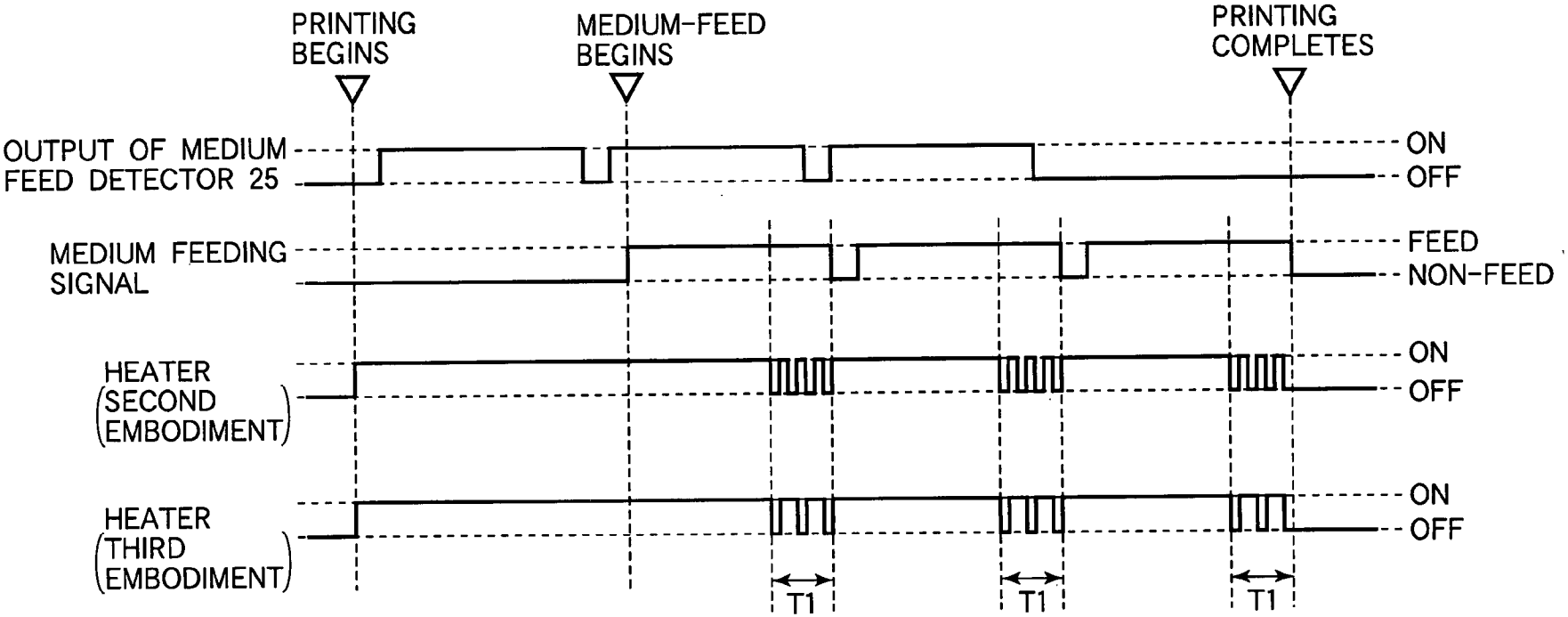
FIG. 11 is a second timing chart illustrating another operation of the third embodiment.
Figure 12:
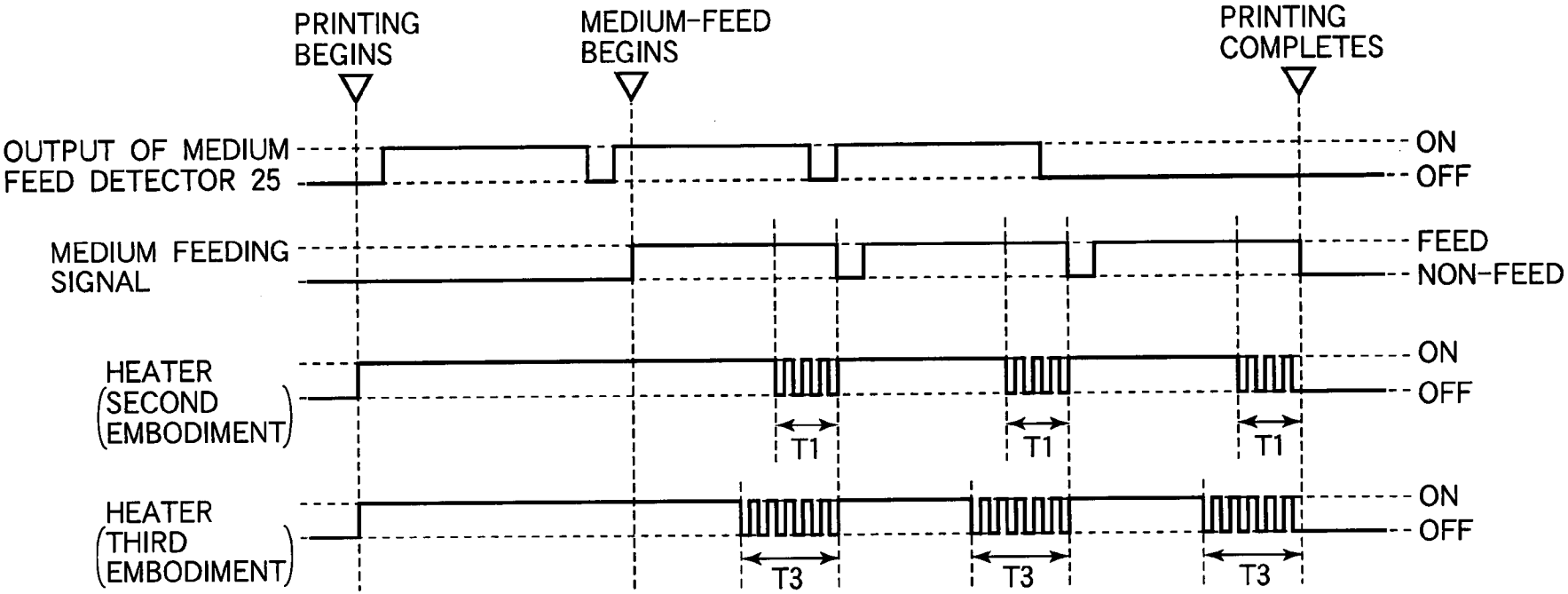
FIG. 12 is a third timing chart illustrating still another operation of the third embodiment.

The heaters 24*a* and 24*b* are turned on or off when the temperature of the heat rollers is out of a predetermined range. This predetermined range is much narrower than an acceptable temperature range (FIG. 4) of the heat rollers. FIG. 10, FIG. 11, and FIG. 12 assume that the temperature of the heat rollers of the fixing unit 24 is lower than the predetermined range and is decreasing before the fixing unit enters the low-energy mode and therefore the heaters 24*a* and 24*b* continue to be energized before the fixing unit enters the low-energy mode.

FIG. 10 is a first timing chart illustrating the operation of the third embodiment.

Referring to FIG. 10, the third embodiment is compared with the first embodiment when the image-forming apparatus operates in a low temperature environment. A medium-feed detector 25 serves as the medium position sensor 16 in FIG. 9. A medium feeding signal is a signal determined based on the detection signals of the medium-feed detector 25 and a discharge sensor 26 and indicates whether the print medium is being advancing in a transport path. A drive signal of the fixing unit 24 indicates whether a heater 24*a* of the fixing unit 24 is energized.

Upon receiving a print command, the print controller 11 receives a length-of-medium from a medium length detector 28 and sends the length-of-medium to the fixing controller 12. Then, print controller 11 receives a value (temperature) indicative of a current environment from an environment detector 29 and sends the value together with a required printing speed to the fixing controller 12.

Upon receiving a length-of-medium, the print controller 12 accesses to a heat energy table 17*a* in a setting table 17 to read a value of the heat energy in the low-energy mode corresponding to the length of print medium 23. Then, upon receiving a value (temperature) indicative of the current environment and a required printing speed of the length-of-medium, the print controller 12 accesses to a distance table 17*b* in the setting table 17 to read a value of the distance in the low-energy mode.

After initiating a printing operation, the print controller 11 monitors the detection signals of the medium-feed detector 25 and the discharge sensor 26 to determine that the print medium begins to pass through time fixing unit 24. When the print medium 23 enters the fixing unit 24, the print controller 12 controls the fixing unit 24 in the normal energy mode.

When the trailing end of the print medium 23 reaches a distance Xa before the nip 40, the print controller 12 controls the fixing unit 24 in the low-energy mode. That is, the fixing controller 12 reduces an amount of heat energy supplied to the fixing unit 24 by intermittently turning on the heaters 24*a* and 24*b* at specific intervals. The print controller 12 controls the fixing unit 24 in the low-energy mode until the trailing end of the print medium 23 has passed the nip 40.

As shown in FIG. 10, the fixing controller 12 according to the third embodiment controls the amount of heat energy supplied to the fixing unit 24, taking effects of the environmental conditions. Therefore, the time T2 for controlling the fixing unit 24 in the low-energy mode is shorter in the third embodiment than in the first embodiment. That is, T2 is shorter than T1. Thus, the fixing unit 24 does not fall short of heat, so that there will be no cold offset.

FIG. 11 is a second timing chart illustrating another operation of the third embodiment, and compares the third embodiment with the second embodiment when the image forming apparatus operates in a low-temperature environment.

Alternatively, the fixing unit 24 may be controlled as shown in FIG. 11 in such a way that the fixing unit is controlled over the same length of time as in the first embodiment but with an increased duty cycle (the ratio of an ON time of said heater to an OFF time of said heater) This allows energizing of the fixing unit 24 with more heat energy than in an example in FIG. 10.

FIG. 12 is a third timing chart illustrating still another operation of the third embodiment, and compares the third embodiment with the second embodiment when the image-forming apparatus operates in a high temperature environment.

As shown in FIG. 12, in a high-temperature environment, the time required for controlling the fixing unit 24 in the low energy mode is shorter in the third embodiment than in the second embodiment. That is, T3 is longer than T1. Thus, the heat supplied to the fixing unit 24 does not become excessive, preventing hot offset.

Subsequently, when the trailing end of the print medium 23 passes through the nip 40, the fixing controller 12 controls again the fixing unit 24 in the normal energy mode. Thereafter, the aforementioned steps of control are performed repeatedly until all of the pages of a printing job have been printed.

Figure 13:
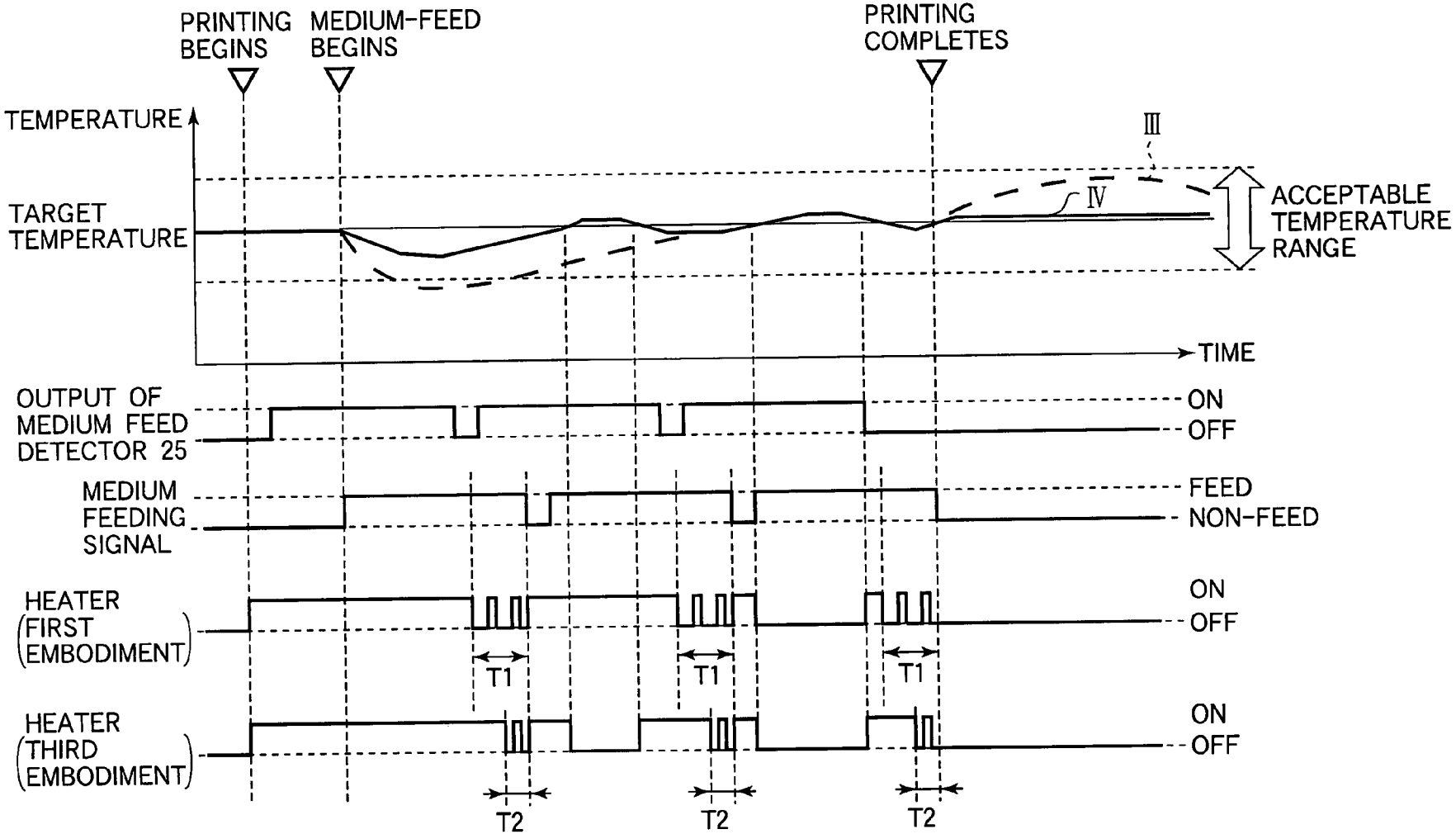
FIG. 13 illustrates changes in temperature of the fixing unit according to the third embodiment.

FIG. 13 illustrates changes in the temperature of the fixing unit 24 according to the third embodiment, and shows the output of the medium-feed detector 25, a medium feeding signal, and a drive signal of the fixing unit.

It is to be noted that the heater controller 13 controls the heaters 24*a* and 24*b* to cycle on and off in accordance with the temperature of the heat rollers in the normal energy mode. When the temperature is lower than a predetermined range and is increasing, the heat controller 13 turns off ($T_P$) the heaters 24*a* and 24*b*. When the temperature is within or higher than the predetermined range and is increasing, the heat controller 13 turns off the heaters 24*a* and 24*b*. When the temperature is lower than the predetermined range and is decreasing, the heat controller 13 turns on ($T_Q$) the heaters 24*a* and 24*b*. In the low-energy mode, the heaters 24*a* and 24*b* are controlled to turn on and off at specific intervals.

As depicted in a solid line IV in FIG. 13, the temperature of the fixing unit 24 is maintained within the acceptable temperature range both during printing and after printing. In contrast, in a low-temperature environment, the fixing unit 24 according to the first embodiment will fall short of heat as depicted in dotted line III (shortly after medium feed begins) shown in FIG. 13, so that the temperature of the fixing unit 24 decreases below the acceptable temperature range.

Figure 14:
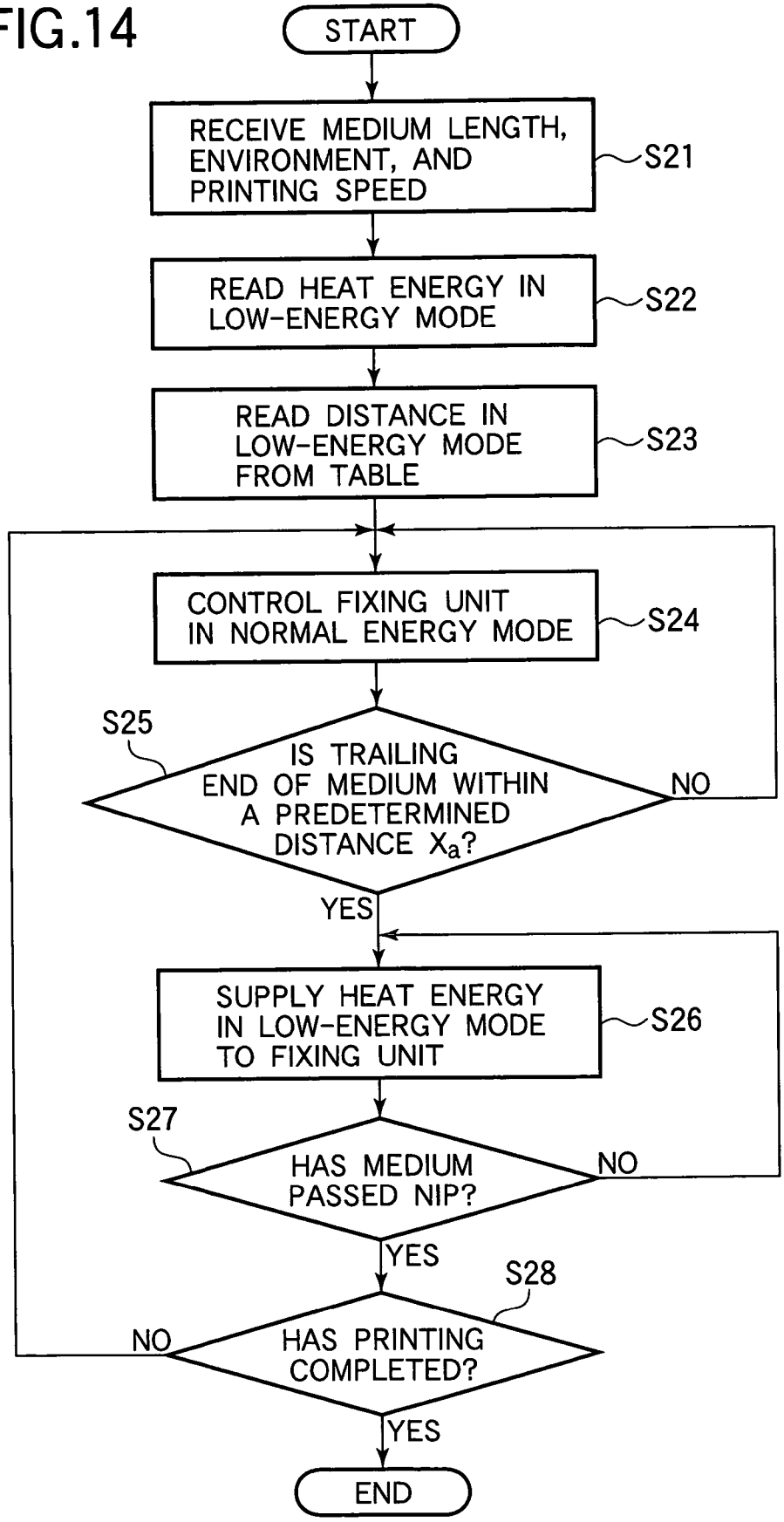
FIG. 14 is a flowchart illustrating the operation of the image-forming apparatus according to the third embodiment.

FIG. 14 is a flowchart illustrating the operation of the image-forming apparatus according to the third embodiment.

The flowchart will be described with reference to FIG. 14.

Step S21: The print controller 11 receives a length-of-medium from a medium length detector 28, a value (temperature) indicative of a current environment, and a required printing speed from the environment detector 29.

Step S22: The print controller 12 reads the heat energy in the low energy mode from the setting table 17.

Step S23: The print controller 12 reads a value of the distance in the low energy mode from the setting table 17.

Step S24: The print controller 12 controls the fixing unit 24 in the normal energy mode.

Step S25: A check is made to determine whether the trailing end of the print medium 23 is within the distance Xa (second heat energy supplying distance) from the nip 40. If the answer is YES, then the program proceeds to step S26. If the answer is NO, the program jumps back to step S24.

Step S26: The print controller 12 supplies the heat energy in the low energy mode to the fixing unit 24.

Step S27: A check is made to determine whether the print medium has passed the nip 40. If the answer is YES, then the program proceeds to step S28. If the answer is NO, the program jumps back to step S26.

Step S28: A check is made to determine whether printing has been completed. If the answer is YES, then the program ends. If NO, the program jumps back to step S24.

In the third embodiment, the amount of heat energy supplied to the fixing unit 24 is controlled taking printing conditions such as environmental condition and printing speed into account. Thus, an optimum amount of heat energy may be supplied irrespective of changes in printing conditions. This prevents an abrupt decrease in the temperature of the fixing unit 24 so that the temperature of the fixing unit 24 will not overshoot. Therefore, regardless of changes in printing conditions, the third embodiment maintains the print quality and throughput of the image-forming apparatus.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus having a fixing unit that applies heat energy to a non-fused developer on a medium, the apparatus comprising:

a heater that supplies heat energy to the fixing unit;

a controller that operates selectively in a first mode in which said controller causes said heater to supply a first amount of heat energy to the fixing unit when a trailing end of the medium is a predetermined distance more upstream of the fixing unit with respect to a direction of travel of the medium, and in a second mode in which said controller causes said heater to supply a second amount of heat energy to the fixing unit when a trailing end of the medium is within a predetermined distance more upstream of the fixing unit, the second amount of heat energy being smaller than the first amount of heat energy.

2. The image forming apparatus according to claim 1, further comprising:

a medium length detector that outputs a first detection signal indicative of a length of the medium; and a medium position detector that outputs a second detection signal indicative of passage of a leading end of the medium with respect to the direction of travel of the medium;

wherein said controller monitors the first detection signal and the second detection signal to detect a timing at which the trailing end of the medium passes through the fixing unit.

3. The image forming apparatus according to claim 1, further comprising:

a medium length memory that holds a length of medium; and a medium position detector that detects passage of a leading end of the medium;

wherein said controller monitors the length of medium and the passage of the leading end of the medium to detect a timing at which a trailing end of the medium passes through the fixing unit.

4. The image forming apparatus according to claim 1, further comprising a temperature detector that detects a temperature of an environment, wherein when said controller operates in the second mode, said controller changes temperature control in accordance with a detection result of the temperature detector.

5. The image forming apparatus according to claim 4, wherein said controller changes the predetermined distance in accordance with a detection result of the temperature detector.

6. The image forming apparatus according to claim 4, wherein when said controller changes a ratio of an ON time of said heater to an OFF time of said heater in the second mode.

* * * * *